US010267125B2

(12) United States Patent
Bertani

(10) Patent No.: US 10,267,125 B2
(45) Date of Patent: Apr. 23, 2019

(54) SHALE GAS EXTRACTION

(71) Applicant: ANNSCA ENERGY PTY LTD., Sydney, New South Wales (AU)

(72) Inventor: Romolo Lorenzo Bertani, North Ryde (AU)

(73) Assignee: ANNSCA ENERGY PTY LTD, Sydney (AU)

( * ) Notice: Subject to any disclaimer, the term of this patent is extended or adjusted under 35 U.S.C. 154(b) by 148 days.

(21) Appl. No.: 15/311,947

(22) PCT Filed: May 22, 2015

(86) PCT No.: PCT/AU2015/050271
§ 371 (c)(1),
(2) Date: Nov. 17, 2016

(87) PCT Pub. No.: WO2015/176139
PCT Pub. Date: Nov. 26, 2015

(65) Prior Publication Data

US 2017/0122080 A1 May 4, 2017

(30) Foreign Application Priority Data

May 22, 2014 (AU) ..... 2014901918

(51) Int. Cl.

| | |
|---|---|
| ***E21B 43/02*** | (2006.01) |
| ***E21B 43/08*** | (2006.01) |
| ***E21B 33/10*** | (2006.01) |
| ***E21B 43/12*** | (2006.01) |

(Continued)

(52) U.S. Cl.
CPC ..... *E21B 43/08* (2013.01); *E21B 33/10* (2013.01); *E21B 43/10* (2013.01); *E21B 43/12* (2013.01);

(Continued)

(58) Field of Classification Search
CPC ..... E21B 43/02
See application file for complete search history.

(56) References Cited

U.S. PATENT DOCUMENTS

| | | | |
|---|---|---|---|
| 5,082,053 | A | 1/1992 | Bernhardt |
| 5,323,855 | A | 6/1994 | Evans |

(Continued)

FOREIGN PATENT DOCUMENTS

| | | | |
|---|---|---|---|
| CN | 102434131 | A | 5/2012 |
| WO | WO2006/130649 | A2 | 12/2006 |

OTHER PUBLICATIONS

Bertani, Extended European Search Report, EP15795690.5, dated Jun. 16, 2017, 6 pgs.

(Continued)

*Primary Examiner* — D. Andrews
(74) *Attorney, Agent, or Firm* — Morgan, Lewis & Bockius LLP

(57) ABSTRACT

The present invention relates to system and method for extracting shale gas through a bore hole located within a geological area. The system and method comprises a production pipe surrounded by a filter assembly, where the production pipe passes through different geological layers, such as a water permeable layer above an underlying shale layer. During extraction of gas from the shale layer, the filter assembly can capture and filter out any contaminants that are released before they enter the water permeable layer. The filter assembly includes lower expandable bell and a stacked arrangement of filters. A vacuum may be used to encourage filtration.

16 Claims, 19 Drawing Sheets

(51) Int. Cl.

| | |
|---|---|
| ***E21B 43/14*** | (2006.01) |
| ***E21B 43/10*** | (2006.01) |
| ***E21B 43/26*** | (2006.01) |
| ***E21B 49/08*** | (2006.01) |
| ***E21B 47/10*** | (2012.01) |
| *E21B 43/38* | (2006.01) |

(52) U.S. Cl.
CPC ..... *E21B 43/14* (2013.01); *E21B 43/26* (2013.01); *E21B 47/10* (2013.01); *E21B 49/08* (2013.01); *E21B 43/38* (2013.01)

(56) References Cited

U.S. PATENT DOCUMENTS

| | | | | |
|---|---|---|---|---|
| 5,673,752 | A | 10/1997 | Scudder et al. | |
| 6,174,108 | B1 | 1/2001 | Suthersan | |
| 7,048,048 | B2 | 5/2006 | Nguyen et al. | |
| 2003/0051874 | A1 | 3/2003 | Munson et al. | |
| 2012/0067587 | A1* | 3/2012 | Agrawal | C08J 9/36 166/309 |
| 2012/0211226 | A1 | 8/2012 | Guest et al. | |
| 2016/0032693 | A1* | 2/2016 | Lehrling | E21B 33/1208 166/387 |

OTHER PUBLICATIONS

Bertani, Romolo Lorenzo, International Search Report and Written Opinion, PCT/AU2015/050271, dated Jun. 2, 2015, 8 pgs.
Bertani, Notification of the First Office Action, CN2015800261150, dated Jul. 26, 2018, 10 pgs.

* cited by examiner

SHALE GAS EXTRACTION

CROSS REFERENCE TO RELATED APPLICATIONS

This application is a United States National Stage Application filed under 35 U.S.C. § 371 of PCT Patent Application Serial No. PCT/AU2015/050271 filed on May 22, 2015, which claims the benefit of Australian Patent Application No. 2014901918, filed May 22, 2014, the entire content of which is incorporated herein by reference.

FIELD OF THE INVENTION

The present disclosure relates to shale gas extraction including extraction techniques utilising hydraulic fracturing (fracking).

BACKGROUND OF THE INVENTION

Shale gas is a natural gas that can be found in shale formations. To extract shale gas from shale formations, hydraulic fracturing (fracking) has been used to assist the release of the shale gas so it can be extracted to the surface for use.

Hydraulic fracturing involves injecting a fracturing fluid, which can include water mixed with sand and other chemicals, at high pressure into the shale formation containing the shale gas. The pressure of the hydraulic fluid causes the fractures in the shale rock that open to create fissures in the rock. The sand (or other proppant in the fracturing fluid) keeps the fissures open so that formation fluids, e.g. shale gas, can flow through the fractured shale formation. A production pipe is provided to the fractured shale formation, known as the production zone, and the shale gas is then extracted from the production zone to the surface through the production pipe.

In some areas, the shale formation is located below a water permeable rock layer, which may include an aquifer. It also is desirable to reduce or minimise contamination to the water in the aquifer for environmental reasons. It is desirable to reduce or minimise contamination to any other formations or areas outside the production zone for similar reasons. Further, uncontrolled leakage of shale gas may add to greenhouse gas emissions.

SUMMARY OF THE INVENTION

In a first aspect, the present disclosure provides a system for extracting shale gas in an area including a water permeable layer above an underlying shale layer, the system including: a production pipe located in a bore hole that passes through the water permeable layer to the shale layer; filter means surrounding at least a portion of the production pipe in the bore hole, wherein the filter means is provided at and/or below the water permeable layer to capture at least one contaminant before it enters the water permeable layer.

In one form the contaminant includes a shale gas. The contaminant may also include one or more of the following chemicals: cyanide, hydrochloric acid, formic acid, boric acid, other acids, quaternary ammonium chloride, sodium chloride, methanol, acetaldehyde, petroleum distillate, potassium, and metaborate.

In one form, the water permeable layer includes an aquifer, wherein the filter means is provided at least in the region of the bore hole passing through a phreatic zone of the aquifer. The filter means is located from the region of the bore hole passing through the phreatic zone of the aquifer to a region above a water table of the aquifer.

In one form, the bore hole passes through an impermeable layer located between the water permeable layer and the shale layer, wherein the filter means are located from the region of the bore hole passing through the water permeable layer to at least part of a region of the bore hole in passing through the impermeable layer.

In one form, the system further includes: a least one filter assembly, wherein the filter assembly includes: a hollow pipe adapted to receive a portion of the production pipe; and a filter portion surrounding an outwardly facing portion of the hollow pipe and forming part of the filter means.

In one form, the system further includes cement in an annular space between the production pipe and an inner surface of the hollow pipe, wherein the cement assists in securing the filter assembly and the production pipe.

In one form, the at least one filter assembly includes: a first pipe coupling at a first end of the hollow pipe; and a second pipe coupling at a second end of the hollow pipe, wherein the first pipe coupling of the filter assembly is adapted to couple with the second pipe coupling of an adjacent filter assembly to enable end to end coupling of multiple filter assemblies.

In one form, the at least one filter assembly is adapted to receive a removable sheath surrounding the filter portion, wherein the removable sheath is provided to protect the filter portion before use, and in use the removable sheath is removed to expose the filter to the bore hole. In a further form, the filter portion has a collapsed configuration and an expanded configuration, wherein in the collapsed configuration an overall diameter of the filter assembly is less than the overall diameter of the filter assembly when the filter portion is in the expanded configuration, wherein the collapsed configuration assists in locating the filter assembly to the in use location in the bore hole.

In one form, the filter assembly is adapted to receive the removable sheath when the filter portion is in the collapsed configuration.

In one form, when the filter assembly is in the in use position, the filter portion in the expanded configuration is in contact with the adjacent wall of the bore hole.

In one form, the system further includes at least one gas or pollution sensor located with the filter means, wherein data from the gas or pollution sensor can be used to derive the state of contamination of the filter. The gas or pollution sensor may be part of the filter assembly.

In a further form, the system includes a funnel located below the filter means, wherein the funnel is provided to channel rising gases towards the filter means. The funnel may include an inlet and an outlet having an opening directed to the filter means, wherein the inlet has an opening larger than an opening of the outlet, and in use the inlet is directed downwardly so such that rising gases below the funnel are received into the inlet and channeled to the outlet towards the filter means.

In one form of the system, a fracturing fluid is pumped to the shale layer to fracture shale in the underlying shale layer to form a production zone and a portion of the production pipe is located at the production zone to extract shale gas.

In one form of the system, part of portion of the production pipe extends, at least in part, in a horizontal direction across the production zone.

In a further form, the system includes at least one aspirator pipe having at least one inlet to remove a contaminant from the production zone, wherein the at least one inlet is located between the a phreatic zone of an aquifer in the water permeable layer and the production zone. The contaminant from the production zone includes at least one of residual gases from the production zone, or at least one component or compound of the fracturing fluid.

In one form, the at least one aspirator pipe includes a material that produces a magnetic field, or includes a magnetic field generator to generate a magnetic field associated with the aspirator pipe, and the fracking fluid includes a ferrofluid, wherein the magnetic field is provided to attract the ferrofluid in the fracking fluid towards the at least one aspirator pipe.

In one form, the at least one inlet of the aspirator pipe is located approximately halfway between the phreatic zone and the production zone. In a further form, the at least one aspirator pipe includes a plurality of aspirator pipes to form an array of inlets, wherein the array of inlets is a substantially planar array. In one form, the substantially planar array is substantially horizontal.

In one form, the at least one aspirator pipe further includes at least one gas or pollution sensor to detect the presence of one or more gases or pollutant.

In another aspect, the present disclosure provides a method of capturing at least one contaminant in proximity to a production pipe in a down hole bore for shale gas extraction, the down hole bore passing through a water permeable layer to an underlying shale layer, the method including: providing filter means to surround at least a portion of the production pipe in the bore hole at and/or below the water permeable layer to capture at least one contaminant before it enters the water permeable layer.

In one form, the method further includes providing a funnel located below the filter means, wherein the funnel channels rising gases to the filter means.

In another aspect, the present disclosure provides a method of recovering components of a fracking fluid including a ferrofluid in proximity of a production zone during shale gas extraction, the method including the steps of; providing at least one aspirator pipe in proximity to the production zone, the aspirator pipe having a material that produces a magnetic field, or a magnetic field generator is provided to generate a magnetic field associated with the aspirator pipe; attracting the ferrofluid in the fracking fluid towards the at least one aspirator pipe with the magnetic field; aspirating the ferrofluid through the aspirator pipe.

In another aspect, the present disclosure provides a method of completing a down hole bore for shale gas extraction, the down hole bore passing through a water permeable layer to an underlying shale layer, the method including: drilling a bore hole to the shale layer, the bore hole being dimensioned to receive both a production pipe and a filter means; providing the production pipe through the bore hole to the shale layer; providing the filter means in the bore hole, the filter means surrounding a portion of the production pipe in the bore hole, wherein the filter means is located at and/or below the water permeable layer to capture at least one contaminant before it enters the water permeable layer.

In one form, the water permeable layer is an aquifer, and the method further includes: providing the filter means from the said part of the region of the bore hole passing through the water permeable layer to the water table of the aquifer.

In one form, the bore hole passes through an impermeable layer located between the water permeable layer and the shale layer, and the method further includes: providing the filter means from the region of the bore hole passing through the water permeable layer to at least part of a region of the bore hole in passing through the impermeable layer.

In one form, the method further includes providing a funnel located below the filter means, wherein the funnel channels rising gases towards the filter means.

In one form, the filter means is part of at least one a filter assembly including: a hollow pipe adapted to receive a portion of the production pipe; and a filter portion surrounding an outwardly facing portion of the hollow pipe, wherein a removable the sheath surrounds and protect the filter portion before use, wherein the step of providing the filter means in the bore hole includes the steps of: lowering the at least one filter assembly having a surrounding sheath protecting the filter portion down the bore hole; locating the at least one filter assembly in the in-use location; and removing the sheath.

In a further form, the method of completing the down hole bore includes providing a plurality of filter assemblies to form the filter means in the bore hole, wherein each filter assembly includes: a first pipe coupling at a first end of the hollow pipe; and a second pipe coupling at a second end of the hollow pipe, wherein the first pipe coupling of the filter assembly is adapted to couple with the second pipe coupling of an adjacent filter assembly to enable end to end coupling of multiple filter assemblies, wherein the method further includes the steps of: lowering a subsequent filter assembly having a surrounding sheath protecting the filter portion down the bore hole to a location above a previously located filter assembly in the in-use location; coupling the subsequent filter assembly to the previously located filter assembly; and removing the sheath of the subsequent filter assembly.

In another aspect, the present disclosure provides a filter assembly for use in the above mentioned system, the filter assembly including: a hollow pipe adapted to receive a portion of the production pipe; and a filter portion surrounding an outwardly facing portion of the hollow pipe.

In one form, the filter assembly further includes: a first pipe coupling at a first end of the hollow pipe; and a second pipe coupling at a second end of the hollow pipe, wherein the first pipe coupling of the filter assembly is adapted to couple with the second pipe coupling of an adjacent filter assembly to enable end to end coupling of multiple filter assemblies.

In another form, the filter assembly is adapted to receive a removable sheath surrounding the filter portion, wherein the removable sheath is provided to protect the filter portion before use, and in use the removable sheath is removed to expose the filter to the bore hole.

In one form, the filter portion has a collapsed configuration and an expanded configuration, wherein in the collapsed configuration an overall diameter of the filter assembly is less than the overall diameter of the filter assembly when the filter portion is in the expanded configuration, wherein the collapsed configuration assists in locating the filter assembly to the in use location in the bore hole.

In one form, the filter assembly is adapted to receive the removable sheath when the filter portion is in the collapsed configuration.

In one form, the filter assembly includes at least one gas or pollution sensor located with the filter means wherein data from the gas or pollution sensor can be used to derive the state of contamination of the filter.

In another aspect, the present disclosure provides a funnel for use with the above mentioned system, the funnel including an inlet and an outlet, wherein the inlet has an opening larger than an opening of the outlet.

DETAILED DESCRIPTION OF THE EMBODIMENTS

Overview

Figure 1:
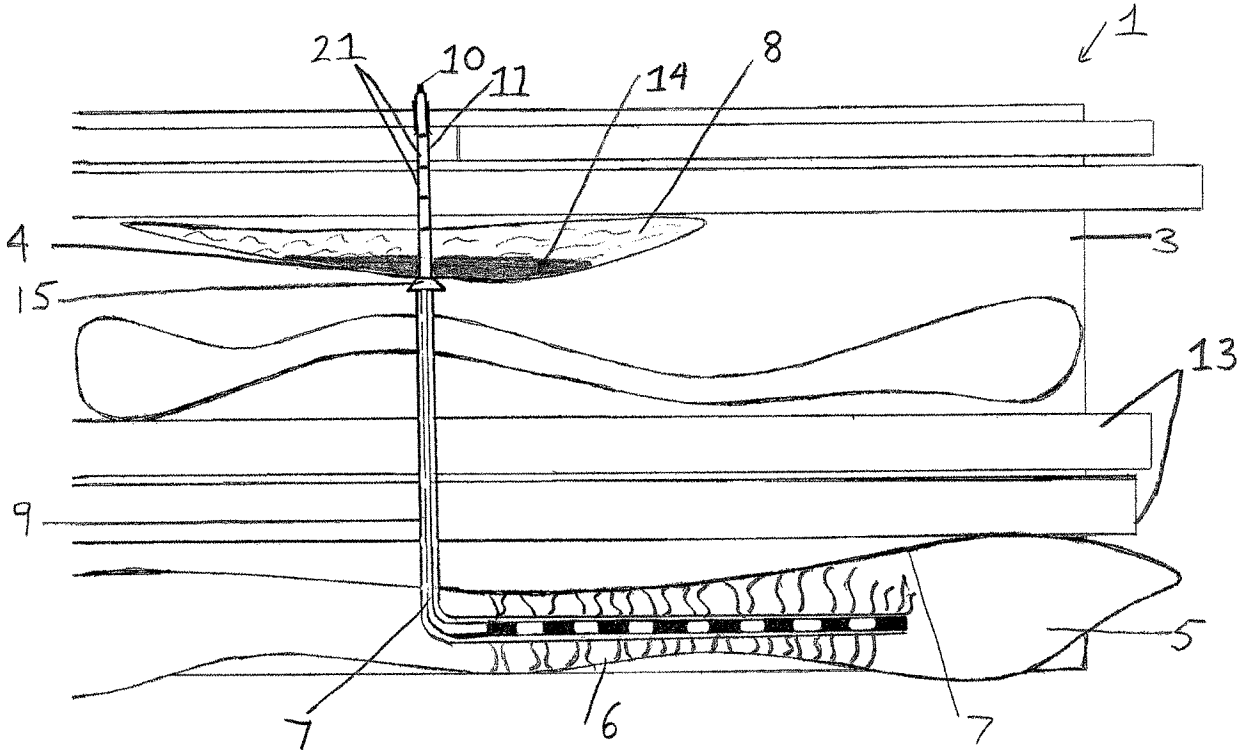
FIG. 1 is a sectioned perspective view of a one embodiment of a system for shale gas extraction.

FIG. 1 illustrates a system 1 for shale gas extraction. A water permeable layer 3 overlies the area where the shale gas is extracted, which includes an underlying shale layer 5. The system includes a well head 10 from which a production pipe 7 extends into a bore hole 9 that passes through the water permeable layer 3 and to the shale layer 5. Filter means 11, in the form of a plurality of filter assemblies 21 joined end to end, are also located in the bore hole 9 and surround a portion of the production pipe 7, wherein the filter assemblies 21 are provided in at least part of a region of the bore hole 9 below the water permeable layer 3.

In one embodiment, the filter assemblies 21 are also provided around the production pipe 7 where the production pipe passes through a phreatic zone 4 of an aquifer 8 in the water permeable layer 3. The filter assemblies 21 can capture at least one contaminant that may have leaked from a production zone 6 of the shale layer 5. This may include shale gas leaking from the production zone 6 that, due to lower density, rises upwards at or around the bore hole 9 towards the well head 10. This may alleviate issues with sealing the production pipe 7 and the walls of the bore hole 9 in the regions around the boundary of the production zone 7, whereby a poor seal may result in shale gas leaking from the production zone 6 along or around the bore hole 9. Alternatively, or in addition, the filter assemblies 21 can capture at least one contaminant that may have leaked at or around the production pipe 7. Such leakage may include instances where the production pipe 7 or surrounding cement has cracked or fractured causing a leak from the production pipe 7. Furthermore, the filter assemblies 21 may attract one or more contaminants around the area of the filter assemblies 21, thereby reducing or preventing contaminants (or fluids and chemicals) in the vicinity of the filter assemblies 21 from passing between formation layers that the bore hole 9 passes through.

It is to be appreciated that in some embodiments the filter assemblies 21 can capture some, but not all of the at least one contaminant. Therefore reference to capture described herein may include capturing substantially all of the contaminants, or alternatively a portion of contaminants. That is, some embodiments of the filter may capture contaminants to reduce the overall amount of contaminants that leak from contaminating one or more layers of substrate. In some embodiments the filter assemblies 21 can capture the at least one contaminant by absorbing and/or adsorbing the contaminant.

In the illustrated embodiment, an impermeable layer 13 is located between the water permeable layer 3 and the shale layer 5. The filter assemblies 21 are provided around the production pipe 7 from a region of the impermeable layer 13 through to the phreatic zone 4 of the aquifer 8 and to a region above a water table 14 of the aquifer 8. This configuration may reduce or minimise contamination of the water in the aquifer 8.

Below the lowermost filter assembly 21 that is located at the impermeable layer 13 is a funnel 15. The funnel 15 is provided to channel leaking gas that may permeate upwards from an area beneath the funnel 15 towards the filter assemblies 21.

The components of the system will now be described in detail.

Filter Assembly

First Embodiment—Expandable and Collapsible Filter Portion

The filter assembly 21 according to a first embodiment will now be described with reference to FIGS. 2 and 3.

Figure 2:
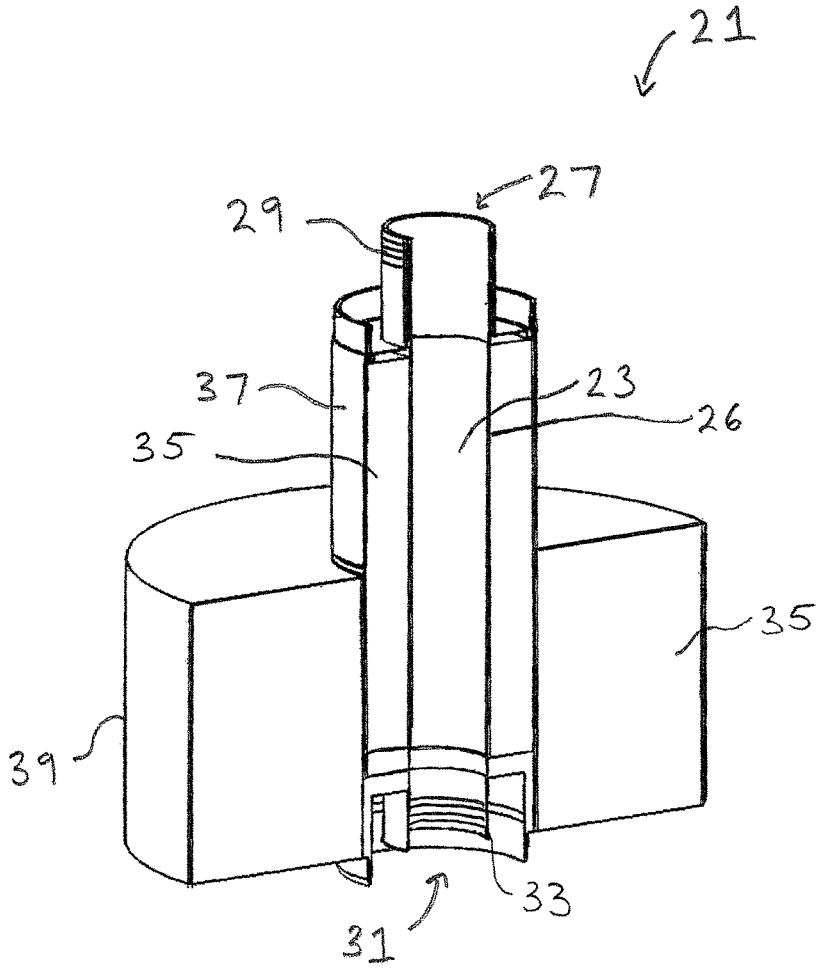
FIG. 2 is a sectioned perspective view of a filter assembly with one filter portion in the expanded configuration and another filter portion in the collapsed configuration.

FIG. 2 illustrates a filter assembly 21 that includes a hollow pipe 23 through which a portion of the production pipe 7 extends. In one embodiment, as illustrated in FIG. 3, the diameter of the hollow pipe 23 is sized to provide clearance 24 not only for the width of the production pipe 7, but also to allow cement to be provided between the outer wall of the production pipe 7 and the inside wall 25 of the hollow pipe 23, typically in the order of 1 to 2 cm.

At a first end 27 of the hollow pipe 23 is a first pipe coupling 29 which is in the form of external threads on an outer pipe surface. At a second end 31 of the hollow pipe 23 is a second pipe coupling 33 which is in the form of complementary internal threads. The first and second pipe couplings 29, 33 are adapted to allow similar adjacent filter assemblies 21 to couple to each other at corresponding ends. Thus multiple filter assemblies 21 can be connected to one another, end to end, to form an indefinite length of coupled filter assemblies. It is to be appreciated other forms of pipe couplings, different from the threaded connections described above, may be used.

A filter portion 35 is provided on an outwardly facing portion 26 of the hollow pipe 23. In the illustrated embodiment the filter portion 35 is substantially annular and surrounds the outwardly facing portion 26 of the hollow pipe 23.

Figure 3:
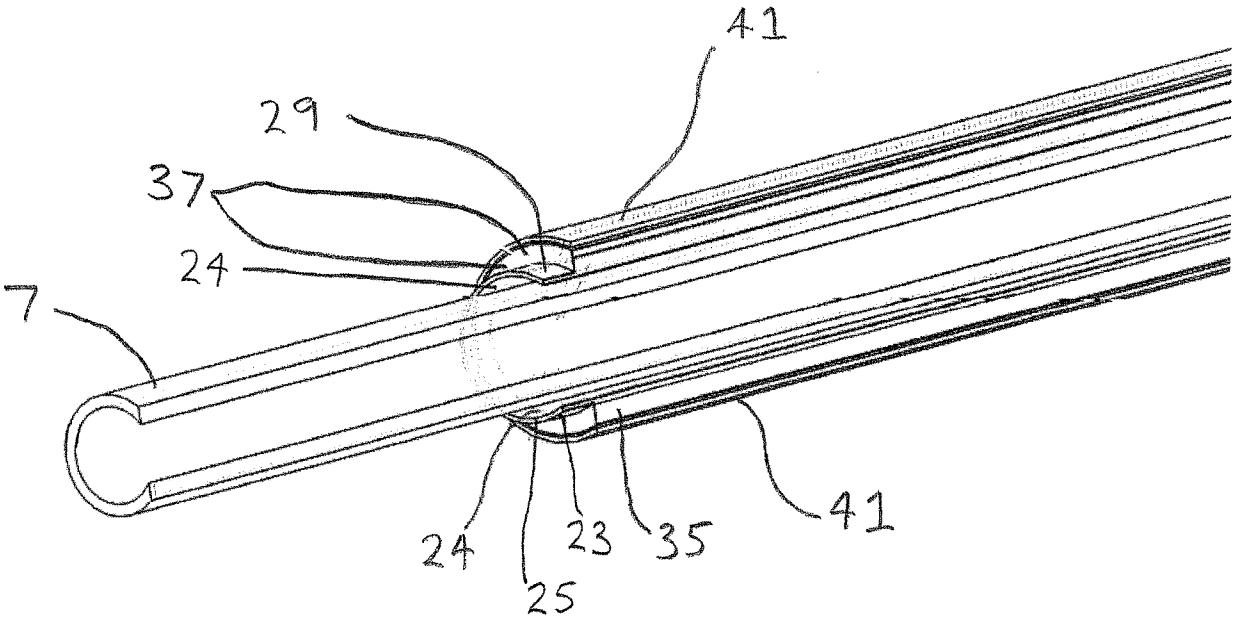
FIG. 3 is a sectioned view of a portion of the filter assembly of FIG. 2 with a section of a production pipe.

In the embodiment illustrated in FIGS. 2 to 3, the filter assembly 21 includes two filter portions 35, where the filter portions 35 can have a collapsed configuration 37 and an expanded configuration 39. Although illustrated with one filter portion 37 collapsed and another filter portion 39 expanded, it is to be appreciated the filter assembly 21 can be configured to have both filter portions 35 collapsed or both filter portions 35 expanded. When the filter portions 35 are in the collapsed configuration 37, the overall diameter of the filter assembly 21 is reduced when compared to the overall diameter of the filter assembly when one, or more, of the filter portions 35 is in the expanded configuration. Since the overall diameter is smaller in the collapsed configuration 37, this assists in moving and locating the filter assembly 21 down the bore hole 9, which in some portions may have a diameter less than the overall diameter when a filter portion 35 is in an expanded configuration. This may be advantageous to allow a smaller diameter bore at portions of the bore hole 9 above the in-use location of the filter assembly 21. This reduces the requirement to ream a larger bore hole 9 from the well head 10 to the in-use location of the filter assembly 21. This may provide some saving in drilling/reaming time, effort, and cost.

The filter portions 35 may be expanded from the collapsed state by pumping a fluid to the collapsed filter portion 35. In one embodiment, the expansion of the filter portion may be caused by pumping a gas, or gases, to inflate the filter portion 35. In one embodiment the filter assembly 21 may include one or more inflation chambers to assist in expansion. In a further embodiment the expansion chambers are integral to the filter portions 35. The gases may be pumped through a conduit from the well head 10 down to the filter portion 35 to be selectively inflated. Suitable gases to expand the filter portion may include nitrogen, and compressed air.

Referring to FIG. 3, the filter assembly 21 can receive a removable protective sheath 41 to protect the filter portion 35. The removable protective sheath 41 may be a pipe or pipe-like structure, and may be formed of metal, plastics, fibre-reinforced plastics, or other suitable material. The removable protective sheath 41 serves to protect the filter portion 35 when it is not in use, in particular when the filter assembly 21 is being lowered down the bore hole 9 to the in-use position. Thus the sheath 41 prevents the filter portions 35 from scraping the walls of the bore hole 9 whilst the filter assembly is moved in the bore hole 9.

In the embodiment shown in FIG. 3, the removable protective sheath 41 assists to keep the filter portion 35 in the collapsed configuration 37. That is, the sheath 41, surrounding the filter portion 35, prevents the filter portion 35 from expanding. This may be useful in some embodiments where the filter portion 35 is compressed to the collapsed configuration, and the sheath 41 can provide a compressive force to maintain the filter portion 35 in the compressed configuration.

The removable protective sheath 41 can be connected to one or more cables (not shown) that are located through the bore hole 9 from the wellhead 10. The cable(s) allow the sheath 41 to lifted from the filter assembly 21 after the filter assembly is located in the in-use position.

In one form, a releasable locking mechanism (not shown) is provided to secure the sheath 41 to the filter assembly 21. The releasable locking mechanism, when locked, retains the sheath 41 to the filter assembly 21, in particular during transportation and/or lowering of the filter assembly 21 down the bore hole 9. When the filter assembly 21 is located at the in-use location, the releasable locking mechanism is unlocked to allow the cable to be retracted to lift the sheath 41 from the filter assembly 21 and towards the well head 10. In one embodiment, the releasable locking mechanism is operatively linked to the connection with the one or more cables such that when there is an amount of tension in the cable, the releasable locking mechanism is unlocked. Thus in use, after the filter assembly 21 is located in the in-use location, the cable is tensioned to unlock the locking mechanism, and subsequently the tensioned cable lifts the sheath 41 towards the well head 10 for removal.

In another embodiment, the protective sheath 41 is secured to the filter assembly 21 by shear pins (not shown). After the filter assembly 21 is lowered and secured (such as by cementing or coupling with other filter assemblies) to the in-use position, the cable is tensioned to lift the sheath 41. The resultant force causes the shear pins to shear, thereby allowing the sheath 41 and filter assembly 21 to separate, and the sheath removed from the bore 9.

In one embodiment the filter portion in the collapsed configuration provides the filter assembly 21 with an overall diameter of less than 600 mm, and in one embodiment less than 500 mm. This overall diameter is enclosed within the inner diameter of the overlying sheath 41, which may be slightly larger than this overall diameter. In one embodiment the filter assembly 21 with the filter portion 35 in the expanded configuration has an overall diameter greater than 2000 mm. In one embodiment, the expanded configuration may be up to and including 2500 mm. It is to be appreciated that although an unobstructed expanded configuration may provide a particular overall diameter, the in-use overall diameter may be smaller if the corresponding area around the in use location is smaller. In a further embodiment it may be advantageous to provide a bore hole 9 with a smaller diameter than the maximum overall diameter in the expanded configuration to ensure a close fit or seal between the filter portion 35 and the wall of the bore hole 9. Advantageously this may allow the filter portion 35, and the overall filter assembly 21, to have closer conformity with the surface of the bore hole 9.

In one embodiment the length of the filter assembly 21 may be between 2 meters to 30 meters. In the particular embodiment the length of the filter assembly 21 may be approximately 25 meters.

Second Embodiment—Fixed Filter Portion

Figure 4:
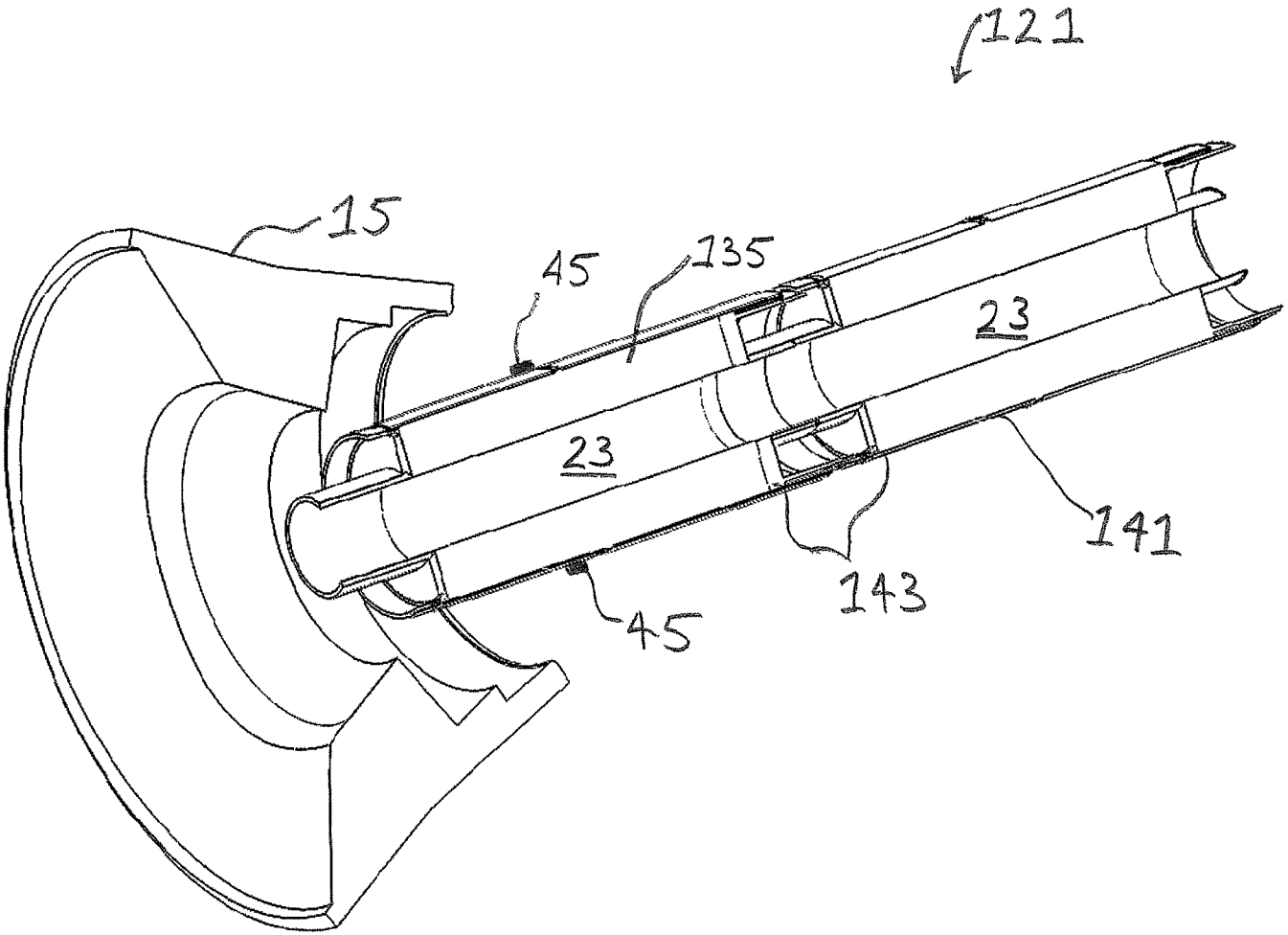
FIG. 4 is a sectioned perspective view of a portion of an alternative embodiment of a filter assembly having a fixed filter portion.
Figure 5:
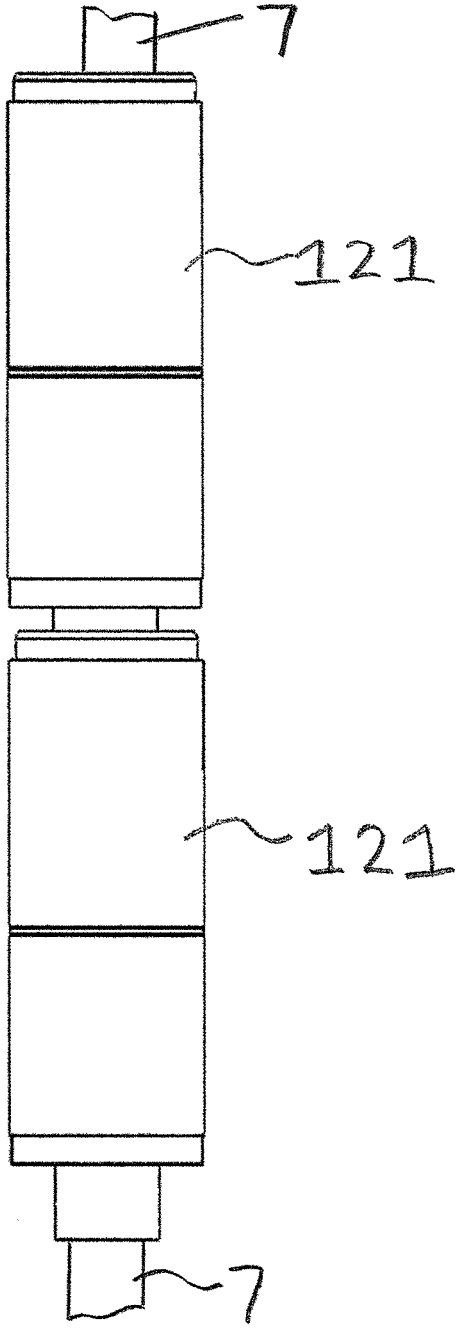
FIG. 5 is a side view of the embodiment of the filter assembly of FIG. 4.
Figure 6:
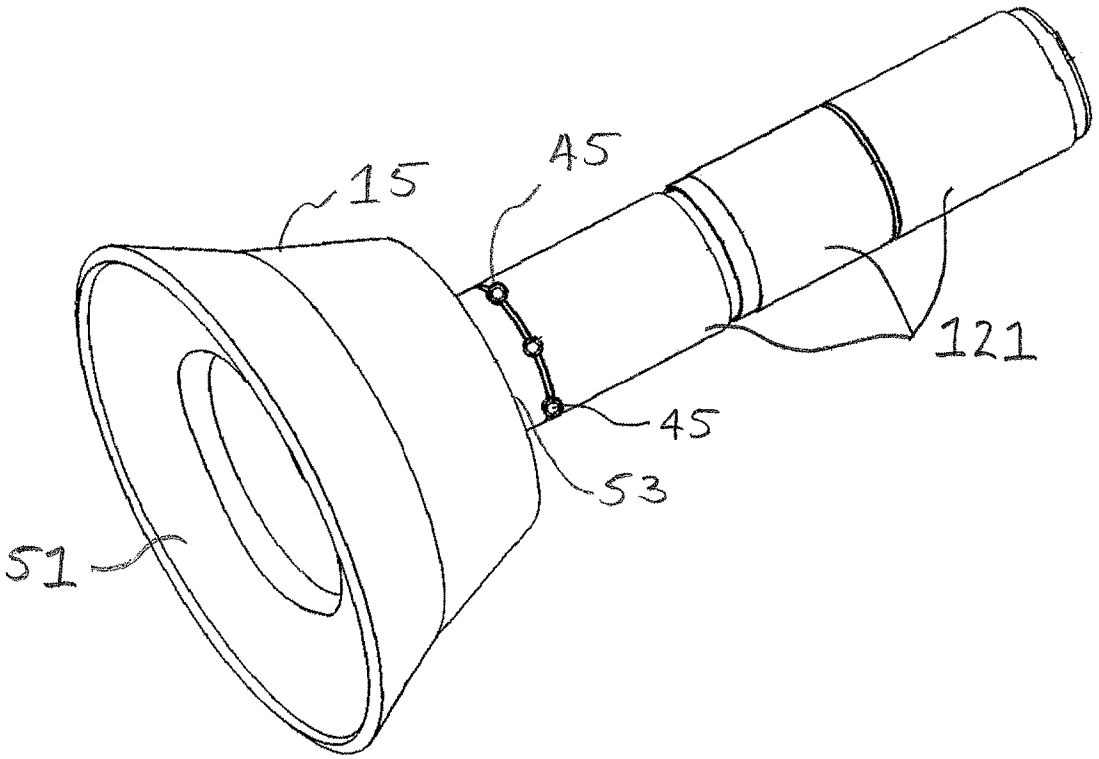
FIG. 6 is a perspective view of a funnel and a portion of the production pipe and filter assembly.

FIGS. 4 to 6 illustrate an embodiment including a filter assembly 121 with a filter portion 135, that is not designed to be substantially collapsed before location down the bore hole 9. Thus in this embodiment, the filter portion 135 has an overall diameter the same as, or close to, the in-use diameter before insertion down the bore hole 9. Referring to FIG. 4, the filter portion 135 may be located and supported around the hollow pipe 23 by spacers 143. In one form the spacers 143 may prop the filter portion(s) 135 to maintain the in-use diameter. A collapsible funnel or bell 15 is located at one end of the filter assembly 121. This is shown more clearly in FIG. 6, which also shows an array of gas detectors 45.

Similar to the first embodiment, an outer sheath 141 may be provided to protect the filter portion 135 during insertion into the bore hole 9. However, since the overall diameter of the filter assembly 121 of this embodiment is larger, the outer sheath 141 would accordingly be of a larger diameter to accommodate the size of the filter assembly 121.

It would be appreciated that in this embodiment, it would be necessary to provide a bore hole 9 of a sufficient diameter to allows the filter assembly 121 with the larger outer sheath 141 to pass down through the bore hole 9 to the in-use location.

FIG. 5 illustrates two filter assemblies 121 of the second embodiment joined together and disposed around a portion of the production pipe 7.

In one embodiment the diameter of the filter assembly including the filter portion 135 may be approximately 2000 mm. The length of the filter assembly 21 may be similar to that of the first embodiment.

Operation (Including Method of Completing Down Hole Bore)

The operation of the system 1, including completing of the down hole bore will now be described with reference to FIGS. 8 to 12. It will be appreciated that some of these steps may be performed in a different sequence without departing from the general concept of the present disclosure.

Figure 8:
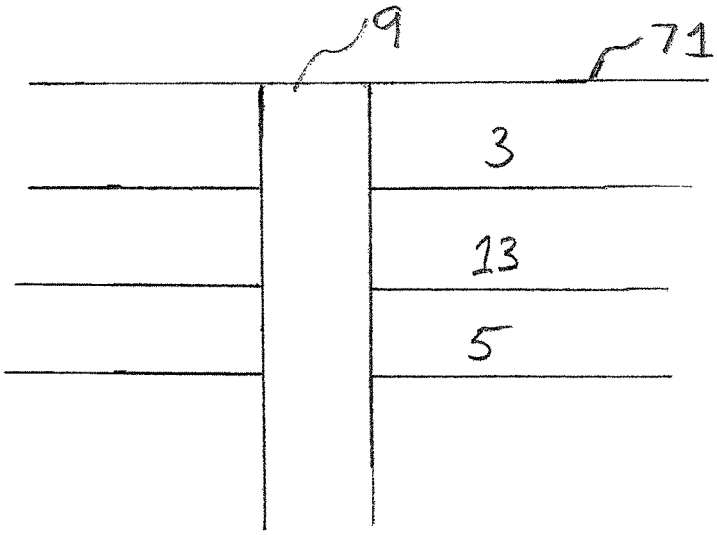
FIG. 8 is a schematic side view of a section of a shale production area showing a bore hole and layers of strata.

Referring to FIG. 8 a bore 9 is drilled from the surface 71, through the water permeable layer 3, the water impermeable layer 13, and to the shale layer 5. In one embodiment the bore 9 is drilled with a diameter of approximately 500 to 600 mm, and reamed at different locations to provide a bore with areas of larger diameter of approximately 2 to 2.5 meters. This may include, in one embodiment, in areas where expandable filter portions 35 of the filter assemblies 21 are to be located in-use, and where the funnel 15 is located in-use.

Figure 9:
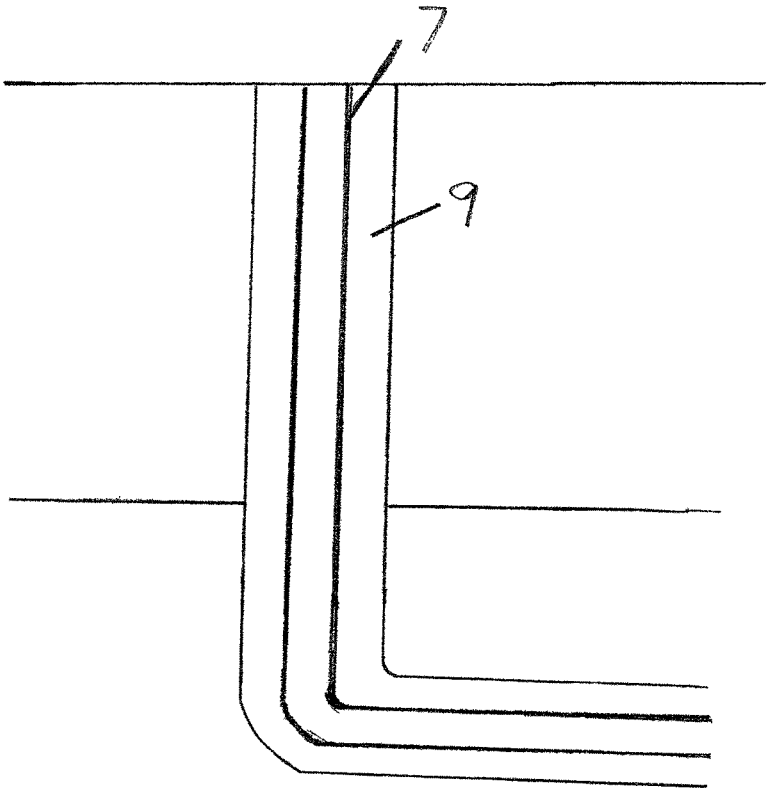
FIG. 9 is a schematic side view of the production pipe in the bore hole.

Referring to FIG. 9 the production case 7 is provided through to the bore hole 9. As illustrated, the bore hole 9, and production case 7 in the production zone 6 may change direction and be substantially horizontal. This arrangement may be advantageous in optimising extraction of shale gas from the production zone.

Figure 10:
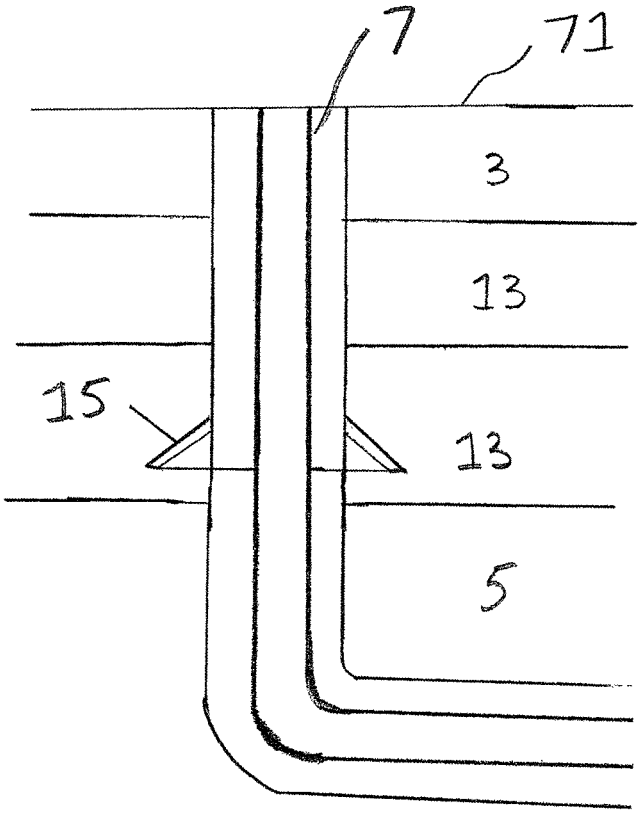
FIG. 10 is a schematic side view of a funnel located in the impermeable layer.

Referring to FIG. 10, the funnel 15 is lowered into the bore hole 9 to the in-use location. In one embodiment the funnel 15 is located at the impermeable layer 13, and in a further form approximately 5 meters below the change between the permeable and impermeable layer. However, it is to be appreciated the funnel 15 may be provided at other locations. Preferably the funnel 15 is located around the production pipe 7 at a region where the production pipe 7 and down hole bore 9 are substantially vertical, or at least before the down hole bore 9 changes to a substantially horizontal direction.

Figure 11:
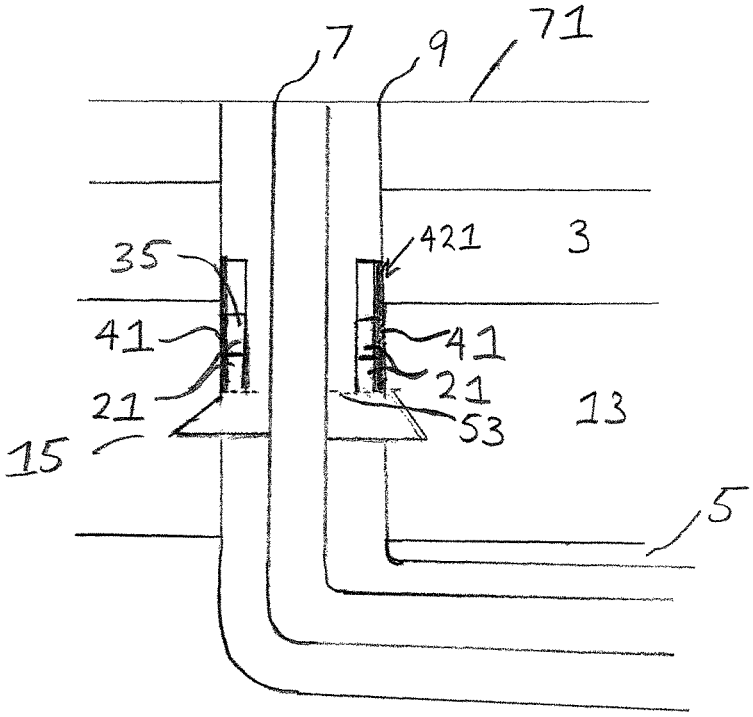
FIG. 11 is a schematic side view of first and second filter assemblies located above the funnel.

Referring to FIG. 11 a first filter assembly 21 is lowered down the bore hole 9 and located above the funnel 15 so that the outlet 53 of the funnel 15 is directed at the filter portion 35 of the filter assembly 21. As illustrated, at least a portion of the first filter assembly 21 is located below the water permeable layer 3. While the first filter assembly 21 is lowered down the bore hole 9, the sheath 41 surrounds the filter assembly 21 to protect the filter portion 35. After the filter assembly 21 is located, the sheath 41 may be removed (as discussed above) and, in embodiments where the filter portion 35 is expandable, the filter portion expanded.

A second filter assembly 421 is then lowered down the bore hole 9 and located above the first filter assembly 21. The first and second filter assemblies 21, 421 are then coupled to each other by the threaded couplings 29, 33. Similar to the first embodiment the sheath 41 may be provided around the second filter assembly 421 as it is lowered down the bore hole 9.

Figure 12:
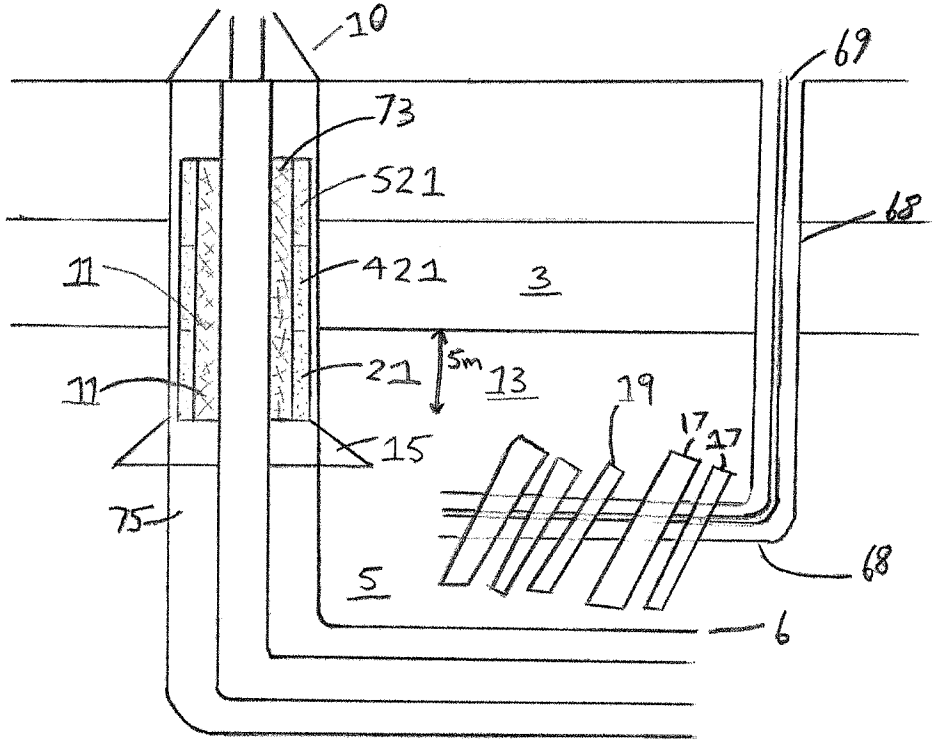
FIG. 12 is a schematic side view of the completed system, where cement is provided between the filter assemblies and the production pipe, and an aspirator array located above the production zone.

Referring to FIG. 12 subsequent filter assemblies 521 are lowered down the bore hole 9 and located above and coupled to a preceding filter assembly. Preferably filter assemblies are located and coupled to each other until the uppermost filter assembly is provided above a location in the water permeable layer 3 where leaking gases may cause unwanted contamination. In one example, this may be at or above the water table, or the phreatic zone 4. In other embodiments this may be all the way through the water permeable layer 3.

Cement 73 is then provided between the production pipe 7 and the hollow pipe 23 of the filter assemblies 21. The cement 73 assists in securing components of the system 1 in place.

In the above mentioned embodiments the sheath 41 is provided to protect the filter portions 35 of respective filter assemblies 21 as they are lowered down the bore hole 9 and removed once the respective filter assembly 21 is located. However in other embodiments the sheath 41 may be removed after more than one, or all, the filter assemblies are located in the in-use location. Similarly the expansion of filter portions 35 may occur singularly as each filter assembly 21 is located, or after more than one filter assemblies 21 are located in position.

Also, referring to FIG. 12, an aspirator array 19 is provided above the production zone 6. The aspirator array is provided by drilling a separate aspirator bore hole 68, and branching of aspirator pipes 17 above the production zone 6.

The operation of the system 1 to filter or reduce contamination will now be described with reference to FIG. 12. Hydraulic fracturing is performed as described above by pumping fracturing fluids into the shale layer 5 to form fissures in the production zone 6. The fracturing fluid is recovered, to the extent possible, through the production pipe 7 and the aspirators 17 (discussed in further detail below).

Shale gas in the production zone 6 is then extracted through the production pipe 7 and towards the well head 10, where it is then transported, stored and/or processed. Some shale gas may leak from the production zone 6 upwards around the bore hole 9 through a path 75. This path 75 may be at or around a transition area between the production zone 6 and the impermeable layer 13. In some circumstances this may be due to poor sealing between the production pipe and the walls of the bore hole 9. Alternatively, strata around the bore hole 9 in that region may be fractured or permeable thereby creating the path for leaking gas. Such shale gases, which may be of a relative lower density than other surrounding matter, may generally rise upwards. The rising gases move through path 75 and towards the funnel 15. The funnel 15 then channels the rising gases to the filter assemblies 21 which then capture the gases, such as by absorbing and/or adsorbing at least some of the gases. This may prevent or reduce the effect of the shale gases polluting the aquifer.

In the event of the production pipe 7 or the cement 73 cracking or having other structural failure causing a contaminant (including shale gas) leak from the production pipe 7, the filter assemblies 21, may assist in capturing at least some of the contaminants to prevent or reduce contamination to the water permeable layer and/or the aquifer.

The aspirator array 19 located above or at the upper regions of the production zone 6 may assist in extracting residual shale gas that is not extracted through the production pipe 7. Furthermore the aspirator array 19 may recover some of the fracturing fluids or components of the fracturing fluid. As discussed above, the fracturing fluid includes a ferrofluid that may be attracted to the magnetic fields associated with the aspirator pipes 17.

In one form the magnetic field associated with the aspirator pipes 17 may be selectively induced, with the magnetic fields induced for selective periods. In one example, the magnetic fields are induced for a period of 10 seconds to attract the ferrofluid, followed by a period of 60 seconds where the magnetic fields are not induced. During the period where the magnetic fields are not induced, the aspirator pipes 17 are active to aspirate gases, fluids, and other contaminates.

In one form, during induction of the magnetic field the aspirator pipes 17 are inactive for at least a period therein. That is, the aspirator pipes 17 are not active to extract (aspirate) gases, fluids, and other contaminants. In another form, during induction of the magnetic field the aspirator pipes are active, for at least a period therein, to aspirate gases, fluids, and other contaminants.

In another embodiment, the magnetic fields associated with the aspirator pipes 17 may be provided constantly to attract the ferrofluids. In yet another embodiment, the aspirators may be constantly active to aspirate gases, fluids, and other contaminants.

Although the above mentioned exemplary embodiment is described with reference to a 10 second induction period of the magnetic field followed by a 60 second inactive period of the magnetic field (and the corresponding 10 second inactive period of the aspirator pipes 17, and 60 second active period of the aspirator pipes 17), it is to be appreciated other combinations of periodic or constant induction of magnetic field and aspiration by the aspirator pipes 17 may be used.

Third Embodiment

Figure 13:
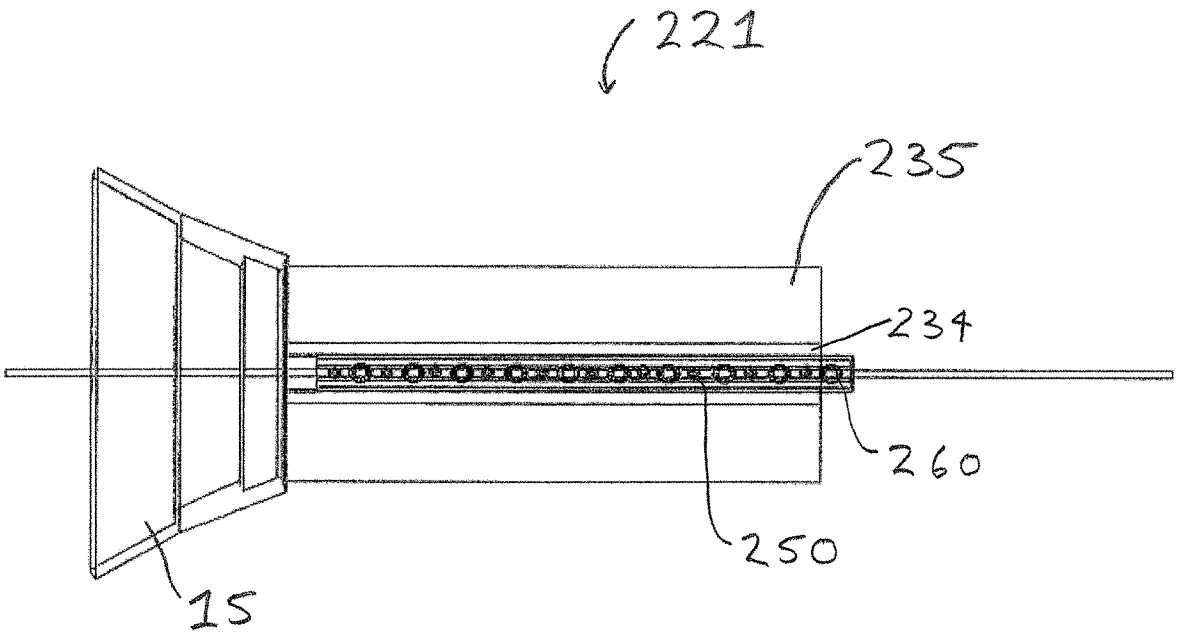
FIG. 13 is a schematic side view of an alternative embodiment of the filter assembly with a funnel.
Figure 14:
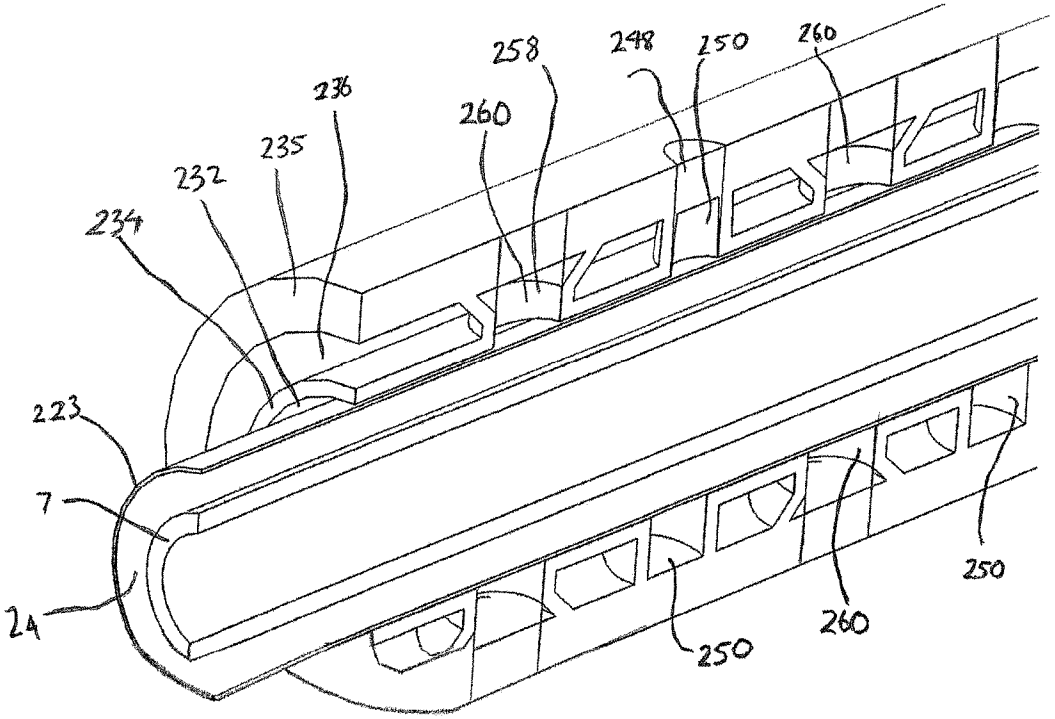
FIG. 14 is a partially sectioned perspective view of the filter assembly of FIG. 13.
Figure 15:
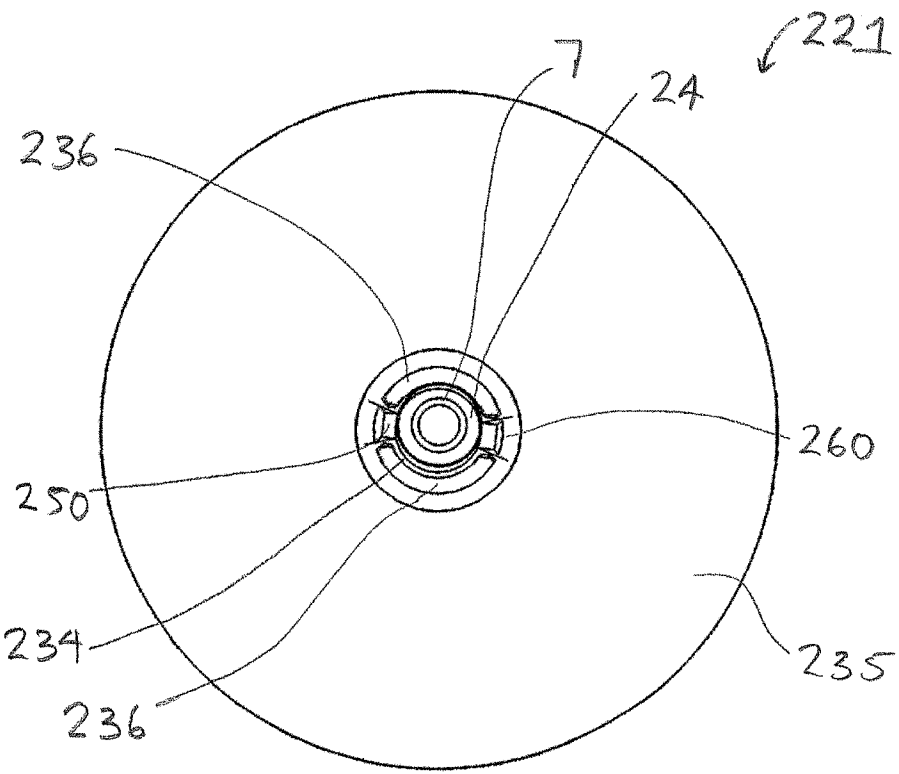
FIG. 15 is a cross-sectional end view of the filter assembly of FIG. 14 with the outer filter portion in the expanded configuration.

FIGS. 13 to 14 illustrate yet another embodiment including a filter assembly 221 with an outer filter portion 235 and inner filter portion 234. This embodiment includes a plurality of gas distribution tubes 250 which supply gas to the filter portions 234, 235 and aspiration tubes 260 to extract gas(es) and other matter from the filter portions 234, 235. Gas, fluids, and other material that may be passed to and from the well head 10 to the gas distribution tubes 250 and aspiration tubes 260 via a common annular conduit 232 are discussed in further detail below. FIG. 15 illustrates the filter assembly 221 in the expanded configuration, and FIGS. 13 and 14 illustrates the filter assembly 221 in the collapsed configuration.

The gas distribution tubes provide pressurised gas for inflating the outer filter portion 235 to the expanded configuration. In addition or alternatively, the gas distribution tubes 250 provide pressurised gas into and around the filter to maintain the outer filter portion 235 in the expanded configuration. Similar to the above described embodiments, the gas may include nitrogen, and compressed air.

The aspiration tubes 260 allow extraction of leaking shale gas, other contaminants, and/or excess gas from the gas distribution tubes 250. Importantly, the aspiration tubes 260 allow removal of shale gas and other contaminants from the outer filter portion 235. This may extend the life of the filter portions 234, 235.

The structure of the filter assembly 221 in this embodiment will now be described in detail. Referring to FIG. 14 the filter assembly 221 is in the collapsed configuration, and a production pipe 7 is in the central region. Surrounding the production pipe 7 is an annular clearance 24 for cement 73. Surrounding the clearance 24 is a hollow pipe 223 of the filter assembly 221. Similar to the hollow pipe 23 described above, the hollow pipe 223 may include couplings to allow adjacent filter assemblies to be connected to one another.

Surrounding the hollow pipe 223 is a substantially annular inner filter portion 234. The annular inner filter portion 234 has a larger inner diameter than the outer diameter of the hollow pipe 223 to provide clearance that forms an annular conduit 232. This annular conduit 232 may be selectively connected to the gas distribution tubes 250 and/or selectively connected to the aspiration tubes 260 discussed in further details below. Thus, the annular conduit 232 may have one mode of operation to be used as a conduit for supplying pressurised gas from the well head 10 to the gas distribution tubes 250 and in another mode of operation be used as a conduit for extracting gas(es), fluids, and/or other contaminants from the aspiration tubes 260 to the well head 10.

Surrounding the inner filter portion 234 is the outer filter portion 235, whereby an annular clearance 236 is provided between the inner filter portion 234 and the outer filter portion 235. The outer filter portion 235 may have a collapsed configuration as shown in FIGS. 13 and 14, or an expanded configuration as shown in FIG. 15

The gas distribution tubes 250 are selectively fluidly connected to the annular conduit 232. In one form, the gas distribution tubes 250 include valves (not shown) to selectively connect to the annular conduit 232. The valves, when open, allow pressurised gas in the annular conduit 232 to pass to the gas distribution tubes 250, whereby the pressurised gas is directed towards the outer filter portion 235 to expand or maintain the outer filter portion 235 in the expanded configuration as shown in FIG. 15.

The aspiration tubes 260 are selectively fluidly connected to the annular conduit 232. In one form, the aspiration tubes 260 include valves (not shown) to selectively connect to the annular conduit 232. The valves of the aspiration tubes 260, when open, allow aspiration of shale gas, other contaminants, and/or fluids (such as gas from the gas supply means or water) from the filter assembly 221 to the well head 10 via the annular conduit 232.

The plurality of gas distribution tubes 250 and the plurality of aspiration tubes 260, in the illustrated embodiment, are alternately provided along the filter assembly 221. In one form, two sets of the tubes are provided with the sets 180 degrees apart.

Similar to the first embodiment described above, the filter assembly 221 may be provided with a removable protective sheath to protect the filter portion 35. The protective sheath preferably covers the filter portion 35 when the filter portion is in the collapsed configuration, to provide protection whilst the filter assembly 221 is lowered down the bore-hole 9 to the in-use position. In the in-use position, the sheath is removed to allow expansion of the outer filter portion 235. To expand, or assist expansion, of the outer filter portion 235 the valves of the gas distribution tubes 250 are open to the annular conduit 232. Pressurised gas is provided to the annular conduit 232, such as by a pump at the well head 10, which in turn provides gas to the gas distribution tubes 250. The gas is then supplied to the outer filter portion 235 to expand the outer filter portion 235. In one embodiment, once expansion of the outer filter portion 235 is completed, the valves of the gas distribution tubes 250 may be closed.

The annular conduit 232 may then be used for extraction of shale gas, other contaminants or fluids. The valves of the aspiration tubes 260 are opened to provide fluid connection of the aspiration tubes 260 to the annular conduit 232. The gas pressure in the annular conduit 232 is then reduced to extract shale gas, contaminants, and/or other fluids from the filter portions 234, 235 through the aspiration tubes 260 and into the annular conduit 232. The extracted material may then be conveyed up to the well head via the annular conduit 232.

Figure 16:
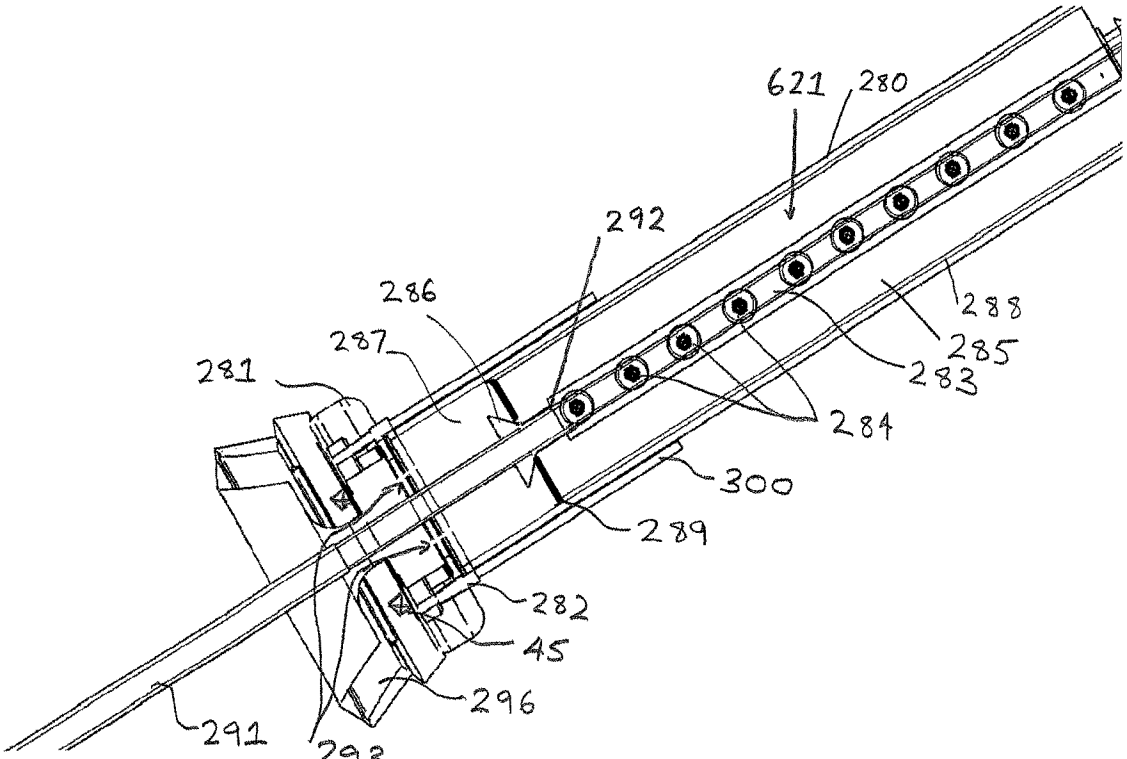
FIGS. 16, 16A and 17 are cross-sectional and side views of further embodiments of a filter assembly.

Referring now to FIG. 16, yet another embodiment is shown including an outer case 280 and a bell 281 connected to the case via a threaded attachment means 282. The case houses a non-expandable filter assembly 621 having a core 283 with a plurality of valves 284 located thereon, which are surrounded by a filter 285. The core 283 of the filter and an outer surface of production pipe 291 defines an inner plenum communicating between the inlet of a funnel 286 via annular passage 292 and a plurality of valve inlets. The funnel is located within a first void 287 at the base of the case, and creates an opening in a barrier 289 separating the void 287 from the filter 285. The valves have outlets communicating via the filter material with an outer annular passage 288 defined between filter and the case. The filter assemblies 621 are connected in series with a void between them.

Figure 16A:
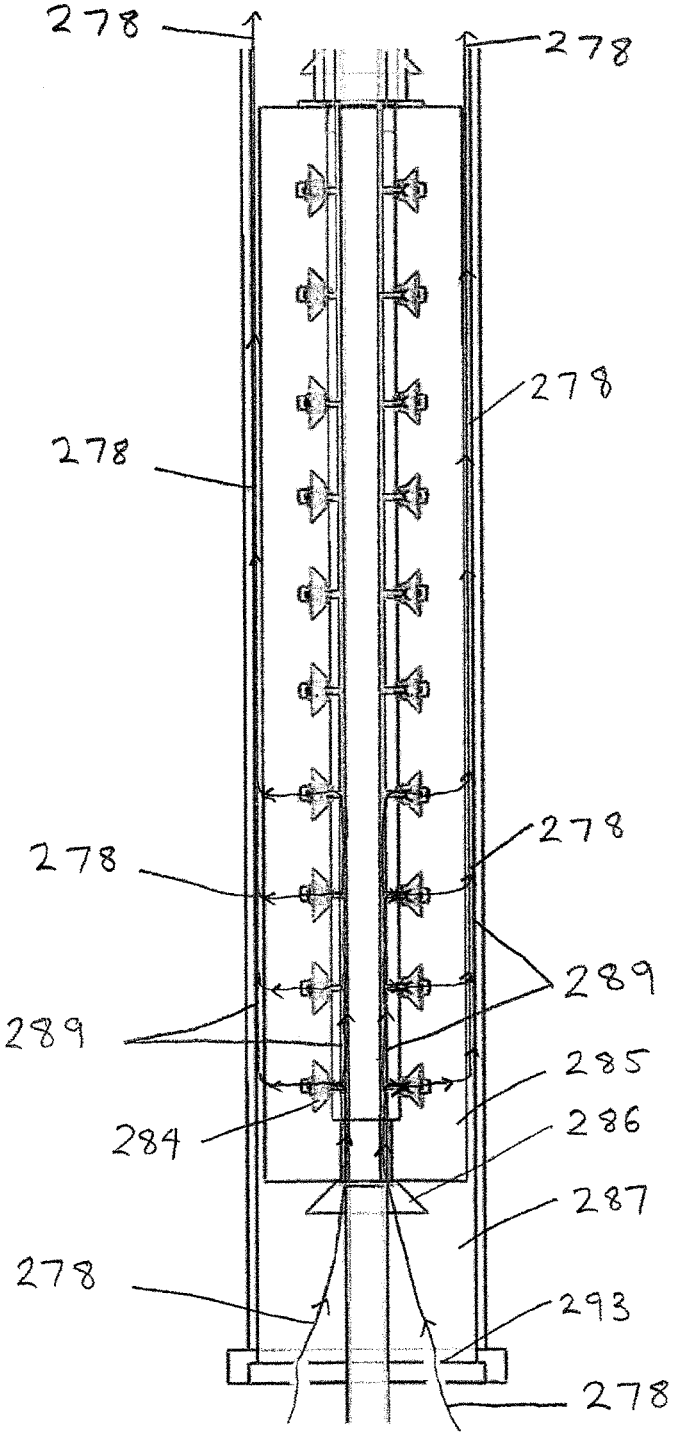

Referring to FIGS. 16 and 16A, during fracking, gases, fluids or other contaminants, as indicated by arrows shown on FIG. 16A and the reference numeral 278, rise through central openings 293 in the bell 15 into the vacuum chamber 287. A vacuum pump at the surface (not shown) creates a vacuum through the filter assembly, drawing the contaminates up through the funnel 286, and into the filter 285 via the one way valves 284. The filters capture the contaminates and filtered fluid and gas travels up though the annular voids 289 to the surface via the remaining filter assemblies, as indicated by the arrows shown on FIG. 16A. The gases, fluids or contaminates are drawn sequentially through each valve 284 by the vacuum operating within the filter 285. As the lower portions of the filter become successively blocked, the contaminates travel up though the progressively higher valves, increasing the longevity of the filter assemblies.

The bell 15 has a hollow skirt 296 which is inflated via pipes 300 which extend from the surface. This allows the bell to expand up against the side walls of the bore hole and form an effective seal to reduce leakage of contaminates.

Inflating Pipes

Figure 17:
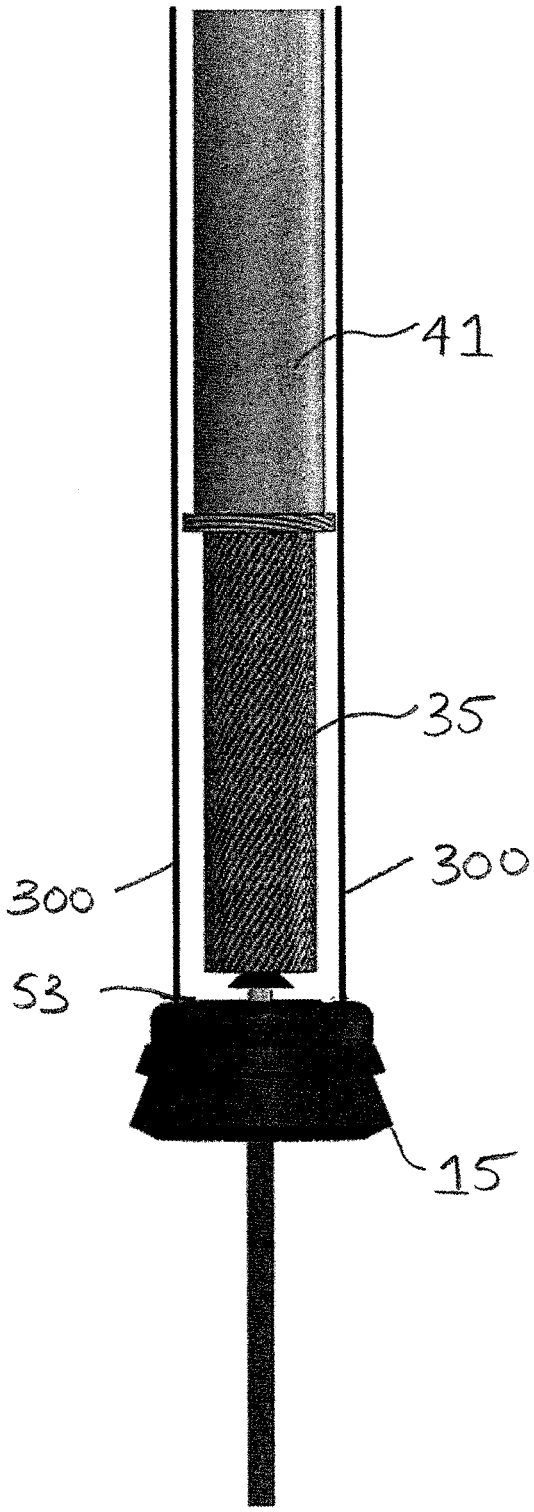

As is shown in FIG. 17, the funnel or bell 15 may be inflated when a filter assembly reaches the in-use location, whereby a removable protective sheath 41 is lifted through the borehole via cables (not shown) to expose the filter portion 35 for use. The funnel 15 is inflated by gas or fluid transported through inflating pipes 300 that extend from the surface along the exterior of the removable protective sheath 41 and filter portion 35 to an inlet 53 of the funnel 15. Alternatively, the funnel 15 may also be inflated by gas or fluid transported through the inflating pipes 300 when the filter assembly is covered by the removable protective sheath as per FIG. 16 or when it is not located in the in-use location. In another embodiment, the inflating pipes 300 are located between the filter portion 35 and the removable protective sheath 41.

Operation of a Filter Assembly Operating with a Vacuum System

Figure 18:
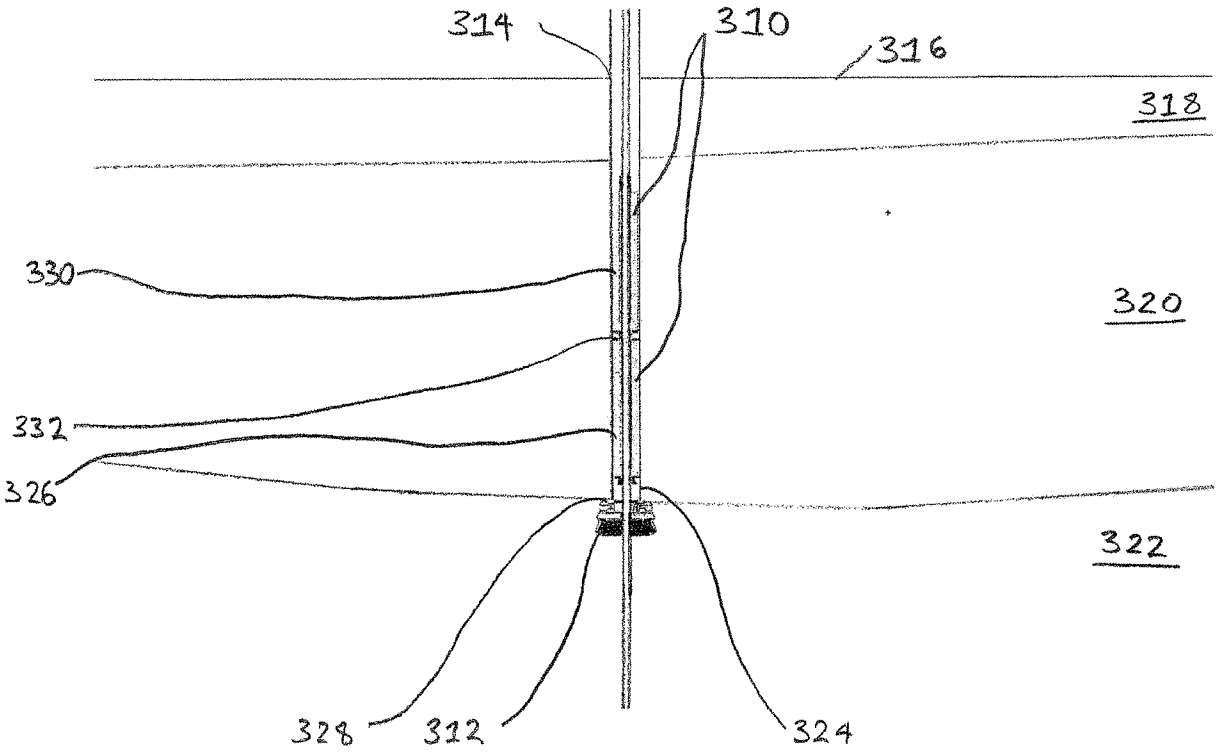
FIG. 18 is a side view of a filter assembly of FIGS. 16, 16A and 17 in situ.

FIG. 18 shows an example of a location where a filter assembly 310 and bell 312 associated with a vacuum system may be used. Initially, a bore 314 is drilled from the surface 316, through an upper shale layer 318 into a water permeable layer 320 and into a lower shale layer 322. A production case 324 is provided through the bore hole 314 and the funnel 312 is lowered into the bore hole 314 to the in-use location. In this example the funnel 312 is located just below the interface between the lower shale layer 322 and the water permeable layer 320 to capture contaminants travelling up around the borehole before they reach the water permeable layer. However, it is to be appreciated the funnel 312 may be provided at other locations to serve a similar function.

A first filter assembly 326 is lowered down the bore hole 314 and located above the funnel 312 so that the outlet 328 of the funnel 312 communicates with first filter assembly 326 as shown in FIG. 16. A second filter assembly 330 is lowered down the bore hole 314 and located above the first filter assembly 326. The first and second filter assemblies 326 and 330 are then coupled to each other by a threaded couplings 332 or other coupling means.

Subsequent filter assemblies may be lowered down the bore hole 314 and located above and coupled to a preceding filter assembly. Preferably filter assemblies are located and coupled to each other until the uppermost filter assembly is provided above a location in the water permeable layer 320 where leaking gases and fluids may cause unwanted contamination. In one example, this may be at or above the water table or may be all the way through the water permeable layer 320.

Electromagnetic Pipe

Figure 19:
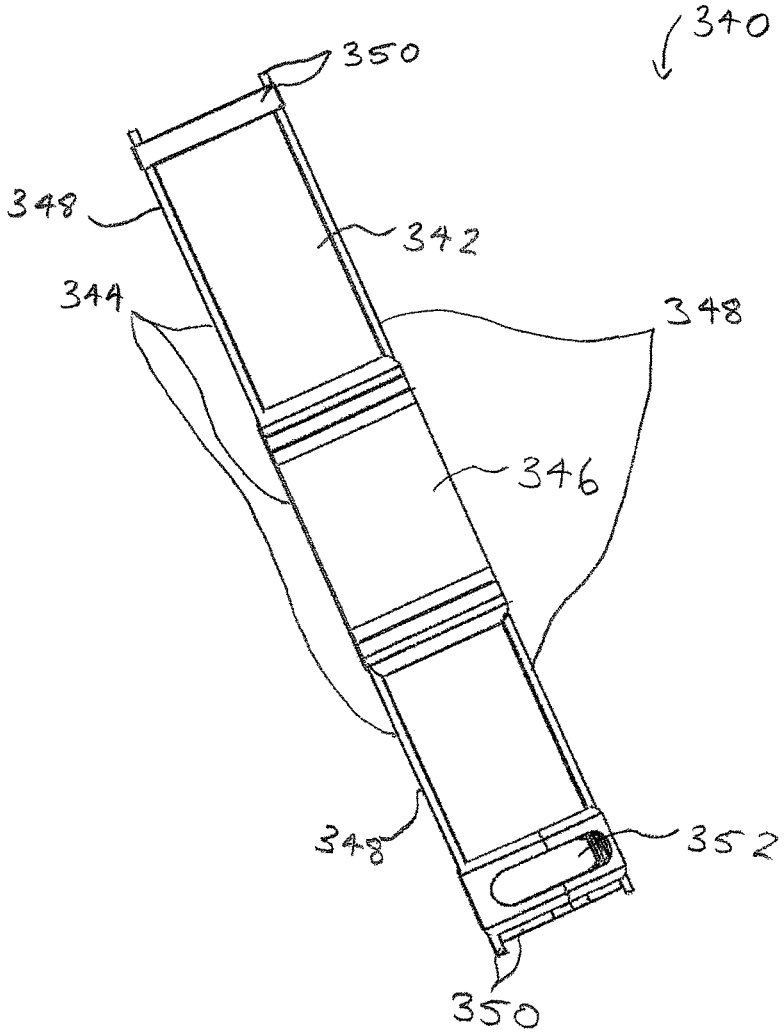
FIG. 19 is a side view of an electromagnetic pipe forming part of a completed system.

FIG. 19 illustrates an electromagnetic pipe 340, which may form part of an electromagnetic pipe array to be used with any of the filter assemblies or aspirator pipes previously described.

The electromagnetic pipe 340 comprises a hollow pipe body 342 located within a housing 344. The housing 344 of the electromagnetic pipe comprises a central magnetic coil area 346 that can be used to induce a radial magnetic field to attract ferrofluids or contaminates located within a fracking fluid. The central magnetic coil area 346 is connected to each end of the housing by outwardly extending arms 348. Each end of the housing further comprises a coupling thread 350 to allow for the connection of multiple electromagnetic pipes through the fracking area. The housing 344 also comprises a fluid inlet area 352 for the entry of the ferrofluids into the hollow pipe body 342 during induction of the radial magnetic field.

It will be appreciated by a person skilled in the art, that the radial magnetic field may be induced by transmitting electric current through the housing 344 or the hollow pipe body 342. In another example, the magnetic field is induced by supplying current to the electromagnetic pipe in pulsations, for example by applying the electric current 20 times in 10 seconds, followed by a period of ten minutes or more where the electric current is applied continuously. In another example, electric current is applied in order to induce a magnetic field lasting approximately 12 to 15 days. In yet another example, electric current is applied in order to induce a magnetic field lasting approximately 15 to 20 days. In a further example, pulsating electric current is applied to the electromagnetic pipe in order to generate a pulsating radial magnetic field. It will also be appreciated that other combinations of periodic or constant induction of the radial magnetic field may be used to attract the ferrofluids or contaminates to the electromagnetic pipe 340. It will further be appreciated that the radial magnetic field may be induced for different periods of time.

Alternatively, the housing 344 or the hollow pipe body 342 may inherently provide a magnetic field by being formed of a material having permanent magnetic properties.

In another form, multiple electromagnetic pipes may form a substantially planar array that is substantially horizontal. In a further form, the magnetic coil may be located in other positions along the housing 344 or may extend along the entire length of the housing 344.

Gas or Pollution Sensors

Gas and/or pollution sensors/detectors 45 are located with the filter assembly 21. The sensors 45 provide information on contaminants in and/or around the filter assembly 21, 121 and the production pipe 7. The sensors 45 provide data to operators and the data may be used to derive the existence of leaking gas and/or the state of contamination of the filter.

In one embodiment, as illustrated in FIG. 6, the sensors 45 are located in the filter portions 135. Thus in this embodiment, the sensors 45 are part of the filter assembly 121. It is to be appreciated that the sensors 45 may also be provided in the first described embodiment of the filter assembly 21 having the collapsible filter portion 35. In one form the outer sheath 45, 145 may protect the sensors 45 as the filter assembly 21, 121 is lowered down the bore hole 9.

In one embodiment, the sensors 45 may be placed near the circumference of the filter portion 35, 135 at approximately equal angular spacing to one another. In another embodiment, as shown in FIG. 16, the detectors are located adjacent the bell opening.

In one embodiment the sensors 45 are provided to detect any one or more of, natural gas, cyanide, hydrochloric acid, formic acid, boric acid, other acids, quaternary ammonium chloride, sodium chloride, methanol, acetaldehyde, petroleum distillate, potassium, and metaborate.

Details of the Filter Assembly

The filter assemblies 21 may include suitable filters that capture contaminants by absorbing or adsorbing one or more of the contaminants discussed herein. In one embodiment the filters may include activated carbon. In another embodiment, the filters are impregnated with high porosity activated carbon produced from agricultural materials, such as nut shells (e.g. walnut, pecan, coconut etc.). The type of material used is selected to yield a high specific surface area, preferably above 1500 $m^2/g$, and favourable absorption properties, such as Iodine and Methylene blue absorption above 1000 mg/g and 400 mg/g, respectively In another embodiment, the filter assemblies 21 include, alone or in combination, a nanofiber to absorb or adsorb the contaminants. An example of a nanofiber filter includes nanofiber filters known as ProTura™ from Clarcor Inc.

The filters may include a material that attracts and absorbs contaminants. In one embodiment the filter assemblies 21 are provided to attract and absorb shale gas. Alternatively or additionally, the filter assemblies 21 may attract and absorb other contaminants including those discussed herein.

The filters may include material that adsorbs contaminants, including shale gas and/or the other contaminants discussed herein.

In yet a further embodiment the filter assemblies 21 may include a combination of materials and structures. For example in one embodiment the filter assemblies 21 include a portion adapted to adsorb contaminants (such as shale gas) around and inside the filter, and another portion adapted to absorb contaminants (including shale gas). In a further form, an aspirator tube may be provided at or near the filter assemblies 21 that is adapted to remove contaminants (including gases) that have accumulated at the filter assemblies 21 that may then be transported up to the surface for accumulation and/or further processing. This arrangement may be advantageous to prolong filter life by removing contaminants from the filter assemblies 21.

In one embodiment the filter assemblies 21 may have a varying density. In one embodiment, the filter portion 35 of the filter assemblies 21 has a greater density closer towards the radial centre (i.e. at the regions proximal to the hollow pipe 7), and a lower density at the peripheral regions relatively distal from the hollow pipe 7. In a further embodiment, the aspirator tube is located at or around the areas of greater density of the filter portion 35.

Funnel

An embodiment of the funnel 15, or bell, is illustrated in FIGS. 4-6. The funnel 15 is attached to a lower most filter assembly 21 and as described above is adapted to channel leaking gases from below the funnel 15 toward the filter assemblies 21. The funnel 15 includes an inlet 51 and an outlet 53, wherein the inlet 51 has an opening that is larger than the opening of the outlet 53. The inlet 51, in use, generally faces downwards, whereas the outlet faces upwards towards the lowermost filter assembly 21.

The inlet 51, in the in-use configuration may have an inlet opening diameter of around 2500 mm, or larger. However, it is to be appreciated the inlet opening diameter may be other sizes, including from 2000 to 4000 mm, and in one embodiment between 3000 to 4000 mm. The outlet 53 has an opening sized to ensure the channeled gases meet the filter portion 35, 135 of the filter assembly 21, 121 and accordingly has a diameter that is the same or less than the diameter of the filter portion 35, 135. In one embodiment the diameter of the opening of the outlet is 2000 mm or less.

In one embodiment, the funnel 15 is located in the impermeable layer 13, and preferably between around 1.5 to 2 meters below the overlying water permeable layer 3. However in other embodiments, the funnel 15 may be located a greater distance below this overlying water permeable layer 3. For example, in another embodiment the funnel 14 is located 5 meters below the overlying water permeable layer 3.

The funnel 15 may be made of a rubber or elastomeric material. The funnel 15 may be elastically deformed to a small diameter to allow the funnel 15 to be lowered down relatively narrower portions of the bore hole 9 that may have a diameter less than 600 mm. Once lowered to the in-use location, the funnel 15 may be expanded to increase the funnel in size. The funnel 15 may be expanded due do the elastic properties of the material forming the funnel. Alternatively, or in combination, the funnel 15 may be biased towards the larger size by a biasing means such as spring member(s) (including spring wire) and/or other elastic or resilient elements. In another form, the funnel 15 may be inflated to the larger size by a gas or fluid.

In another embodiment illustrated in FIG. 16, the funnel 15 may be inflated when the filter assembly reaches the in-use location, whereby the removable protective sheath 41 is lifted through the borehole via cables (not shown) to expose the filter portion 35 for use. The funnel 15 is inflated by gas or fluid transported through inflating pipes 55 or 300 that extend from the surface along the exterior of the removable protective sheath 41 and filter portion 35 to the outlet 53 of the funnel 15. Alternatively, the funnel 15 may also be inflated by gas or fluid transported through the inflating pipes 55 when the filter assembly is covered by the removable protective sheath or when it is not located in the in-use location. In another embodiment, the inflating pipes 55 are located between the filter portion 35 and the removable protective sheath 41.

Aspirator Array

Figure 7:
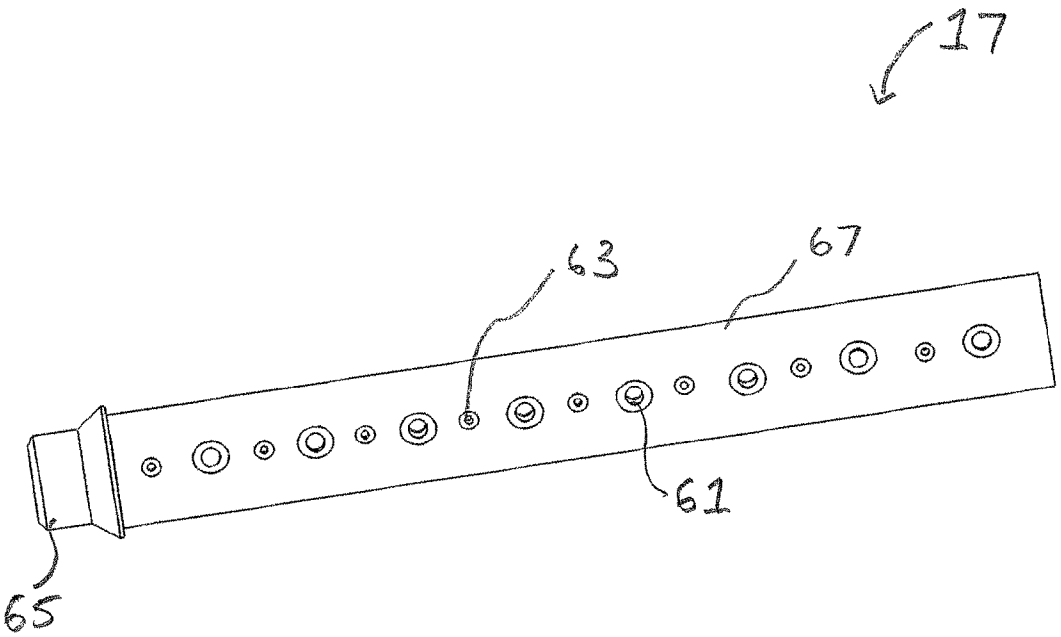
FIG. 7 is a side view of a portion of an aspirator pipe.

FIG. 7 illustrates a section of an aspirator pipe 17, a plurality of which form the aspirator array 19. The aspirator pipe 17 includes a hollow pipe body 67 with a plurality of aspirator apertures 61 located along the length of the body. The aspirator apertures 61 allow removal of residual gases and/or residual fracturing fluid, compounds, and other contaminants or pollutants, from the vicinity where the aspirator pipe 17 is located. In one form the aspirator apertures 61 are located approximately every 200 mm along the length of the aspirator pipe, although it is to be appreciated that the apertures 61 may be located more frequently or less frequently along the length of the pipe 17.

The aspirator pipe is also provided with one or more sensors 63 to detect presence of one or more gases or pollutants.

The aspirator pipe 17 includes couplings 65 to allow connection with other aspirator pipes 17 and other pipe connections to form the aspirator array 19. As illustrated in FIGS. 1 and 12, the aspirator array may be in the form of a substantially planar array that is substantially horizontal.

In one embodiment, the aspirator pipe 17 may inherently provide a magnetic field, or be adapted to generate a magnetic field (such as by providing an electric current through the aspirator pipe 17 or hollow pipe body 67). Alternatively an electric current may be passed through a magnetic coil associated with the aspirator pipe 17. This allows the magnetic field to be selectively induced. In another embodiment, a magnetic field is induced by providing a pulsating electric current through the aspirator pipe 17 or hollow pipe body 67 or magnetic coil, for example by applying the electric current 20 times in 10 seconds, followed by a period of ten minutes or more where the electric current is applied continuously. In a further embodiment, the electric current is provided in order to produce a pulsating magnetic field. In other embodiments, the magnetic field or the pulsating magnetic field will operate for 12 to 15 days or 15 to 20 days. It will be appreciated that other combinations of periodic or constant induction of the magnetic field or pulsating magnetic field may operate for any period of time in order to attract ferrofluids or contaminates to the aspirator pipe 17.

In one embodiment the hollow pipe body 67 of the aspirator pipe 17 is formed of a material having magnetic properties. In another embodiment, the hollow pipe 67 is made of ferromagnetic material.

The aspirator pipe 17 having magnetic properties may be advantageous in recovering compounds having ferrofluid that may be including in the fracturing fluid. This will be discussed in further detail below.

A ferrofluid may include a hydrocarbon based ferrofluid. This may include the EFH series ferrofluid, such as EFH1 from Ferrotec (USA) Corporation.

The aspirator array 19 may be introduced above the production zone 6 but below a phreatic zone 4 of the water permeable layer 3. This advantageously allows aspiration of potentially polluting gases, fluids and other matter from the area near the production zone 6, in particular water in the phreatic zone 4.

In one embodiment the aspirator pipes 17 and array 19 are connected to aspiration tube 68 provided through an aspirator bore hole 69 that is located away from the main bore hole 9. In one form the separate aspirator bore hole 69 is drilled up to and including 100 meter away from the well head 10.

Fracturing Fluid

The fracturing fluid used for hydraulic fracturing includes various components including water, sand and other chemicals. After hydraulic fracturing, it may be desirable to recover the fracturing fluid (in particular the chemicals) from the production zone 6. Some of the fracturing fluid may be recovered through the production pipe 7 running through the bore hole 9 into the production zone 6. However, some of the fracturing fluid may pass through via fissures to a location away from the production pipe 7 making it difficult to recover the fracturing fluid (and importantly the component chemicals) via the production pipe 7.

Therefore in one embodiment the fracturing fluid may further include a component that is a ferrofluid. This ferrofluid is bonded or attracted to one or more other chemicals in the fracturing fluid, as discussed below. In another embodiment, the ferrofluid may comprise a large quantity of ferrite. Advantageously, the ferrofluid (and bonded chemicals) may be attracted to the magnetic field associated with the aspirator pipe 17, which assists in recovery of the chemicals in the fracturing fluid through the aspirator pipe 17. It will be appreciated that the ferrofluid may comprise various quantities of ferric or ferrous or iron-rich material such as magnetite, hematite, or the like.

As noted above, one or more of the chemicals in the fracturing fluid may bonded or attracted to the ferrofluid. In one form, this may be achieved with chemical binder. The binder may include a gel or a gelling agent.

A substantial number of fracturing treatments are completed using thickened, water-based linear gels. The gelling agents used in these fracturing fluids are typically guar gum, guar derivatives such as hydroxypropylguar (HPG) and carboxymethylhydroxypropylguar (CMHPG), or cellulose derivatives such as carboxymethylguar or hydroxyethylcellulose (HEC). Guar gum is a polymeric substance derived from the seed of the guar plant. It is to be appreciated other guar derivatives, in particular non-toxic and/or biodegradable forms, may be used.

Chemicals in the fracturing fluid may include one or more of the following: hydrocholoric acid, glutaraldehyde, quaternary ammonium chloride, tetrakis hydroxymethyl-phosphonium sulfate, ammonium persulfate, sodium chloride, magnesium peroxide, magnesium oxide, calcium chloride, choline chloride, tetramethyl ammonium chloride, isopropanol, methanol, formic acid, acetaldehyde, petroleum distillate, hydrotreated light petroleum distillate, potassium metaborate, triethanolamine zirconate, sodium tetraborate, boric acid, zirconium complex, borate salts, ethylene glycol, polyacrylamide, guar gum, polysaccharide blend, citric acid, acetic acid, thioglycolic acid, sodium erythorbate, lauryl sulfate, sodium hydroxide, potassium hydroxide, sodium carbonate, potassium carbonate, copolymer of acrylamide and sodium acrylate, sodium polycarboxylate, phosphonic acid salt, lauryl sulfate, isopropyl alcohol, and 2-butoxyethanol. These chemicals may be one or more of the contaminants that the filter assemblies 21 capture, such as by absorbing and/or adsorbing.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A system for extracting shale gas in an area including a water permeable layer above an underlying shale layer, the system comprising:

a production pipe located in a bore hole that passes through the water permeable layer to the shale layer;

a filter assembly surrounding at least a portion of the production pipe in the bore hole, wherein the filter assembly is provided at and/or below the water permeable layer to capture at least one contaminant fluid before it enters the water permeable layer, and the filter assembly further comprises:

a hollow pipe adapted to receive a portion of the production pipe;

a filter portion surrounding an outwardly facing portion of the hollow pipe;

a first pipe coupling at a first end of the hollow pipe; and a second pipe coupling at a second end of the hollow pipe, wherein the first pipe coupling of the filter assembly is adapted to couple with the second pipe coupling of an adjacent filter assembly to enable coupling of multiple filter assemblies.

2. The system according to claim 1, wherein the filter assembly is adapted to receive a removable sheath surrounding the filter portion, wherein the removable sheath is provided to protect the filter portion before use, and in use the removable sheath is removed to expose the filter portion to the bore hole.

3. The system according to claim 2, wherein the filter portion has a collapsed configuration and an expanded configuration, wherein in the collapsed configuration an overall diameter of the filter assembly is less than the overall diameter of the filter assembly when the filter portion is in the expanded configuration, wherein the collapsed configuration assists in locating the filter assembly to the in use location in the bore hole.

4. The system according to claim 3, wherein the filter assembly is adapted to receive the removable sheath when the filter portion is in the collapsed configuration, and when the filter assembly is in the in use position, the filter portion in the expanded configuration is in contact with the adjacent wall of the bore hole.

5. The system according to claim 1, wherein a fracturing fluid is pumped to the underlying shale layer to fracture shale in the underlying shale layer to form a production zone and a portion of the production pipe is located at the production zone to extract shale gas, wherein the system further comprises:

at least one aspirator pipe having at least one inlet to remove a contaminant fluid from the production zone, wherein the at least one inlet is located between a phreatic zone of an aquifer in the water permeable layer and the production zone.

6. The system according to claim 5, wherein the at least one aspirator pipe includes a material that produces a magnetic field, or includes a magnetic field generator to generate a magnetic field associated with the aspirator pipe, and the fracking fluid includes a ferrofluid, wherein the magnetic field is provided to attract the ferrofluid in the fracking fluid towards the at least one aspirator pipe.

7. The system according to claim 5, wherein the at least one aspirator pipe comprises a plurality of aspirator pipes to form an array of inlets, wherein the array of inlets is a substantially planar array.

8. The system according to claim 5, wherein the at least one aspirator pipe further includes at least one gas or pollution sensor to detect the presence of one or more gases or pollutants.

9. A system for extracting shale gas in an area including a water permeable layer above an underlying shale layer, the system comprising:

a production pipe located in a bore hole that passes through the water permeable layer to the shale layer;

a filter assembly surrounding at least a portion of the production pipe in the bore hole, wherein the filter assembly is provided at and/or below the water permeable layer to capture at least one contaminant fluid before it enters the water permeable layer; and at least one gas or pollution sensor located within the filter assembly and configured to detect the presence of one or more gases or pollutants, wherein data from the at least one gas or pollution sensor are configured to be used to derive a state of contamination of the filter.

10. A system for extracting shale gas in an area including a water permeable layer above an underlying shale layer, the system comprising:

a production pipe located in a bore hole that passes through the water permeable layer to the shale layer;

a filter assembly surrounding at least a portion of the production pipe in the bore hole, wherein the filter assembly is provided at and/or below the water permeable layer to capture at least one contaminant fluid before it enters the water permeable layer; and a funnel located below the filter assembly, wherein the funnel is provided to channel rising gases towards and through the filter assembly.

11. A method of capturing at least one contaminant fluid in proximity to a production pipe in a bore hole for shale gas extraction, the bore hole passing through a water permeable layer to an underlying shale layer, the method comprising:

providing a filter assembly to surround at least a portion of the production pipe in the bore hole at and/or below the water permeable layer to capture at least one contaminant fluid before it enters the water permeable layer; and providing a funnel located below the filter assembly, wherein the funnel is provided to channel rising gases towards and through the filter assembly.

12. A method of completing a bore hole for shale gas extraction, the bore hole passing through a water permeable layer to an underlying shale layer, the method comprising:

drilling a bore hole to the shale layer, the bore hole being dimensioned to receive both a production pipe and a first filter assembly;

providing the production pipe through the bore hole to the shale layer; and providing a plurality of filter assemblies in the bore hole, including providing the first filter assembly in the bore hole, the first filter assembly surrounding a portion of the production pipe in the bore hole, wherein:

the first filter assembly is located at and/or below the water permeable layer to capture at least one contaminant fluid before it enters the water permeable layer;

the first filter assembly further includes: a hollow pipe adapted to receive a portion of the production pipe, and a filter portion surrounding an outwardly facing portion of the hollow pipe, wherein a removable sheath surrounds and protects the filter portion before use;

the step of providing the first filter assembly in the bore hole further includes the steps of: lowering the first filter assembly having a surrounding sheath protecting the filter portion down the bore hole, locating the first filter assembly in the in-use location, and removing the sheath;

each of the plurality of filter assemblies includes: a first pipe coupling at a first end of the hollow pipe; and a second pipe coupling at a second end of the hollow pipe, wherein the first pipe coupling of the first filter assembly is adapted to couple with the second pipe coupling of an adjacent filter assembly to enable coupling of multiple filter assemblies; and providing the plurality of filter assemblies in the bore hole further includes the steps of:

lowering a subsequent filter assembly having a surrounding sheath protecting the filter portion down the bore hole to a location above a previously located filter assembly in the in-use location;

coupling the subsequent filter assembly to the previously located filter assembly; and removing the sheath of the subsequent filter assembly.

13. A system for extracting shale gas in an area including a water permeable layer above an underlying shale layer, the system comprising:

a production pipe located in a bore hole that passes through the water permeable layer to the shale layer;

a filter assembly surrounding at least a portion of the production pipe in the bore hole, wherein the filter assembly is provided at and/or below the water permeable layer to capture at least one contaminant fluid before it enters the water permeable layer, and the filter assembly further comprises:

a hollow pipe adapted to receive a portion of the production pipe; and a filter portion surrounding an outwardly facing portion of the hollow pipe;

wherein the filter portion is non-expandable and which includes a sheath surrounding the outer portion of the filter and defining an outer annular passage between the outer portion of the filter and the sheath, which communicates with an operatively upper outlet of the filter, an inner passage defined between an inner portion of the filter and the production pipe, which communicates with an operatively lower inlet of the filter, and a plurality of valves arranged along the length of the filter extending transversely between the inlet and outlet passages, wherein a series of fluid paths are defined between the inlet and the outlet via the valves under influence of a vacuum for filtering contaminant fluids through the filter.

14. The system according to claim 13, wherein an operatively lower end of the filter assembly communicates with an expandable sealing bell which is configured to direct contaminating fluids into the filter, and to prevent the egress of fluids up around the outside of the filter assembly.

15. The system according to claim 14, wherein the sealing bell includes an inflation assembly for selectively expanding the sealing bell, and the operatively lower end of the filter includes a funnel for directing contaminating fluid from the sealing bell into the inner passage, the inflation assembly including at least one fluid-carrying pipe extending from the surface.

16. The system according to claim 15, wherein the inner and outer passages and valves are configured so that the filter assembly is successively clogged from bottom to top, and the valves operate in ascending order to filter contaminant fluids.

* * * * *